US007657210B2

(12) United States Patent
Aruga et al.

(10) Patent No.: US 7,657,210 B2
(45) Date of Patent: Feb. 2, 2010

(54) DEVELOPER COLLECTION SYSTEM AND IMAGE FORMING APPARATUS USING THE SAME

(75) Inventors: Tomoe Aruga, Komagane (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 125 days.

(21) Appl. No.: 11/611,040

(22) Filed: Dec. 14, 2006

(65) Prior Publication Data

US 2007/0140739 A1 Jun. 21, 2007

(30) Foreign Application Priority Data

Dec. 20, 2005 (JP) ..... 2005-367493
Dec. 21, 2005 (JP) ..... 2005-367489
Dec. 21, 2005 (JP) ..... 2005-367490
Dec. 21, 2005 (JP) ..... 2005-367491
Dec. 21, 2005 (JP) ..... 2005-367492

(51) Int. Cl.
*G03G 15/10* (2006.01)

(52) U.S. Cl. ..... 399/249

(58) Field of Classification Search ..... 399/249, 399/237, 299, 302, 308
See application file for complete search history.

(56) References Cited

U.S. PATENT DOCUMENTS 5,950,054 A * 9/1999 Kim ..... 399/237
2003/0096186 A1* 5/2003 Viturro et al. ..... 430/117
2005/0158082 A1* 7/2005 Shin et al. ..... 399/237
2006/0210315 A1* 9/2006 Nakamura et al. ..... 399/237
2007/0122181 A1* 5/2007 Kamijo et al. ..... 399/101

FOREIGN PATENT DOCUMENTS

JP 2002-189354 7/2002
JP 2002-296918 10/2002
JP 2003-107913 4/2003

* cited by examiner

*Primary Examiner*—Quana M Grainger
(74) *Attorney, Agent, or Firm*—Hogan & Hartson LLP

(57) ABSTRACT

A developer collection system comprises a plurality of image carrier members, a plurality of development sections for developing the electrostatic latent images formed respectively on the plurality of image carrier members by means of liquid developers of different colors containing a non-volatile solvent as carrier, an intermediate transfer member for sequentially transferring the developer images developed by the primary transfer sections respectively corresponding to the plurality of image carrier members, superposing them one on the other and carrying and conveying the developer images, an output section for transferring the superposed developer images from the intermediate transfer member onto a sheet on a sheet conveyance route in the secondary transfer section and developer collection means for collecting excessive developers from at least two of the plurality of image carrier members, the plurality of development means, the intermediate transfer member and the output section and at least two of the flow channels from the developer collection means are merged to form a single flow channel.

34 Claims, 12 Drawing Sheets

DEVELOPER COLLECTION SYSTEM AND IMAGE FORMING APPARATUS USING THE SAME

CROSS REFERENCE TO RELATED APPLICATIONS

This invention is based upon and claims the benefit of priority from the prior Japanese Patent Application No. 2005-367489, filed on Dec. 21, 2005, Japanese Patent Application No. 2005-367490, filed on Dec. 21, 2005, Japanese Patent Application No. 2005-367491, filed on Dec. 21, 2005, Japanese Patent Application No. 2005-367492, filed on Dec. 21, 2005 and Japanese Patent Application No. 2005-367493 filed on Dec. 21, 2005, the entire contents of which are incorporated herein by reference.

BACKGROUND OF THE INVENTION

This invention relates to a developer collection system comprising a plurality of image carrier members, a plurality of developing apparatus for developing the electrostatic latent images formed on the plurality of image carrier members by means of liquid developers carried by non-volatile respective solvents, an intermediate transfer member for sequentially transferring the toner images developed by the primary transfer sections respectively corresponding to the plurality of image carrier members, superposing them one on the other to form a developer image and carrying and conveying the developer image and an output apparatus for transferring the developer image from the intermediate transfer member on a sheet on a sheet conveyance route in a secondary transfer section for output, and adapted to collect the excessive developers from the plurality of image carrier members, the plurality of developing apparatus, the intermediate transfer member and the output apparatus. The present invention also relates to an image forming apparatus adapted to transfer a toner image formed by laying one on the other from the intermediate transfer member on a sheet in a secondary transfer section and output the image.

Various wet type image forming apparatus for developing a latent image by means of a highly viscose liquid developer prepared by dispersing solid toner into a liquid solvent and visualizing the electrostatic latent image have been proposed. A developer to be used in such wet type image forming apparatus is prepared by suspending solid (toner particles) in an electrically insulating organic solvent (carrier), which is typically made of silicon oil, mineral oil or edible oil. Toner particles are very fine and have a particle diameter of about 1 μm. Thus, if compared with dry type image forming apparatus adapted to use powdery toner particles having a particle diameter of about 7 μm, wet type image forming apparatus can produce high quality images because they use such fine toner particles.

The carrier of a developer operates to prevent fine toner particles with a diameter of about 1 μm from flying away, hold toner particles in an electrically charged state and uniformly disperse them. It also operates to make toner particles easily move under the effect of an electric field in the development step and the transfer step. Thus, while the carrier is an element necessary for storing and transporting toner and also in the development step and the transfer step, it can adhere to non-image regions and, after developing a latent image, the excessive carrier can give rise to a problem of disturbed image transfer and other problems. To avoid these problems, the carrier is removed (squeezed) from the developer on the photosensitive member and the intermediate transfer member as ordinary practice (see, inter alia, Patent Document 1: Jpn. Pat. Appln. Laid-Open Publication No. 2002-296918). When an intermediate transfer belt and a secondary transfer belt are used in wet type image forming apparatus, the liquid developer (including the carrier and the solid) adhering to the surfaces of the belts is removed by means of a cleaning blade (see, inter alia, Patent Document 2: Jpn. Pat. Appln. Laid-Open Publication No. 2002-189354). In the developer recycling process, a plurality of developing apparatus are arranged selectively vis-à-vis the photosensitive drum and squeezing apparatus are arranged also selectively vis-à-vis the photosensitive drum at the downstream side of the developing apparatus to correspond to the latter in order to squeeze the excessive developers on the photosensitive drum by means of the squeezing apparatus and circulate and transport the excessive developers collected by the squeezing apparatus to the developing apparatus by means of a circulating apparatus for the purpose of recycling (see, inter alia, Patent Document 3: Jpn. Pat. Appln. Laid-Open Publication No. 2003-107913).

SUMMARY OF THE INVENTION

Known developer recycling systems as described above are adapted to be used for color image forming apparatus in which a plurality of developing apparatus and a plurality of squeezing apparatus that correspond to the developing apparatus are arranged selectively vis-à-vis a single photosensitive drum and a latent image is developed by a developer. Such color image forming apparatus are so-called on-photosensitive-drum color superposing type color image forming apparatus that develop the latent image of the first color on the photosensitive drum by means of a developer of the first color and squeeze the excessive developer of the first color. Then, the visible image obtained by developing the latent image of the first color proceeds to the step of forming the latent image of the second color, where the latent image of the second color is formed and developed by a developer of the second color and the excessive developer of the second color is squeezed. Subsequently, similar steps of development and squeezing are taken down to the fourth color to form a toner image of superposed colors on the photosensitive drum and the toner image with the superposed colors is transferred on a transfer paper. Squeezing apparatus that correspond to the respective developing apparatus are arranged selectively vis-à-vis the photosensitive drum to squeeze the excessive developers and avoid color mixing of the excessive developers.

The visible image formed on the photosensitive drum by superposing colors also contains unnecessary fogging toner. However, when the fogging toner is squeezed, not only the fogging toner but also the toner of the visible image formed by developing the latent image is partly collected by the squeezing apparatus. Then, it is not possible to prevent color mixing. Therefore, if the excessive developers collected respectively by the squeezing apparatus are transported back to the corresponding developing apparatus for recycling, color mixing gradually progresses in the developing apparatus to make it impossible to maintain a desired condition for the developers.

In view of the above identified circumstances, it is therefore the object of the present invention to provide a developer collection system that can collect developers and send the collected developers that are made free from color mixing back to the respective developing apparatus for the purpose of recycling and maintains developers in a desired condition with a simple arrangement and also an image forming apparatus realized by using such a developer collection system.

According to one embodiment of the present invention, the above object is achieved by providing a developer collection system that comprises: a plurality of image carrier members; a plurality of development means for developing the electrostatic latent images formed respectively on the plurality of image carrier members by means of liquid developers of different colors containing a non-volatile solvent as carrier; an intermediate transfer member for sequentially transferring the developer images developed by the primary transfer sections respectively corresponding to the plurality of image carrier members, superposing them one on the other and carrying and conveying the developer images; a secondary transfer means for transferring the superposed developer images from the intermediate transfer member onto a sheet on a sheet conveyance route in the secondary transfer section; and developer collection means for collecting excessive developers from at least two of the plurality of image carrier members, the plurality of development means, the intermediate transfer member and the secondary transfer means; at least two of the flow channels from the developer collection means are merged to form a single flow channel.

In one implementation of in a developer collection system as defined above, the flow channel formed by the merge is provided with a filter means.

In one implementation of a developer collection system as defined above, the developer collection means are image carrier member squeezing means arranged at the upstream sides of the respective primary transfer sections of the image carrier members in the sense of the moving directions thereof.

In one implmentation of a developer collection system as defined above, the developer collection means are image carrier member cleaning means arranged at the upstream sides of the respective primary transfer sections of the image carrier members in the sense of the moving directions thereof.

In one implementation of a developer collection system as defined above, the developer collection means are intermediate transfer member squeezing means arranged at the downstream sides of the respective primary transfer sections of the intermediate transfer member in the sense of the moving directions thereof.

In one implementation of a developer collection system as defined above, the developer collection means are intermediate transfer member cleaning means arranged at the downstream side of the secondary transfer section of the intermediate transfer member in the sense of the moving direction thereof.

In one implementation of a developer collection system as defined above, the developer collection means is a cleaning means of the secondary transfer roller of the secondary transfer section.

In one implementation of a developer collection system as defined above, each of the plurality of development means includes a developer container for containing developer, a developer toner cartridge for containing developer showing a toner concentration higher than the toner concentration of the developer contained in the developer container, a carrier cartridge for containing the carrier and a developer container for receiving the developer and the carrier supplied respectively from the developer cartridge and the carrier cartridge, agitating them into a uniformly dispersed state and containing them.

In one implementation of a developer collection system as defined above, the carrier separated by the filter is stored in a carrier buffer tank and distributed to the carrier cartridges.

Another embodiment of the invention provides a developer collection system comprising: a plurality of image carrier members; a plurality of development means for developing the electrostatic latent images formed respectively on the plurality of image carrier members by means of liquid developers of different colors containing a non-volatile solvent as carrier; an intermediate transfer member for sequentially transferring the developer images developed by the primary transfer sections respectively corresponding to the plurality of image carrier members, superposing them one on the other and carrying and conveying the developer images; and a secondary transfer means for transferring the superposed developer images from the intermediate transfer member onto a sheet on a sheet conveyance route in the secondary transfer section; image carrier member squeezing means arranged at the upstream sides of the respective primary transfer sections of the image carrier members in the sense of rotation thereof; and an intermediate transfer member cleaning means arranged at the downstream side of the secondary transmission section of the intermediate transfer member in the sense of the moving direction thereof and at the upstream side of the primary transfer section of the first color; the flow channels of the developer collected by the image carrier member squeezing means and the flow channel of the developer collected by the intermediate transfer member cleaning means being merged to a single flow channel.

In one implementation of a developer collection system as defined above, the intermediate transfer member cleaning means includes a developer compression means for compressing the developer on the intermediate transfer member and a cleaning blade arranged downstream relative to the developer compression means in the sense of the moving direction of the intermediate transfer member and held in contact with the intermediate transfer member.

In one implementation of a developer collection system as defined above, the developer compression means includes a compression roller and a cleaning blade for scraping off the developer adhering to the surface of the roller.

In one implementation a developer collection system as defined above, the developer of the merged flow channel is conveyed to a carrier buffer tank, isolated by the filter means and stored in the tank so that the stored carrier may be distributed from the carrier buffer tank to the plurality of development means.

One implementation of a developer collection system as defined above further comprises: image carrier member cleaning means arranged at the downstream sides of the respective primary transfer sections of the image carrier members in the sense of rotation thereof; and an intermediate transfer member squeezing means arranged at the downstream side of the primary transfer sections of the intermediate transfer member in the sense of moving direction thereof; the flow channel of the developer collected by the intermediate transfer member squeezing means and the flow channels of the developer collected by the image carrier member squeezing means arranged at the downstream side thereof being merged to a single flow channel; the flow channel of the developers collected by the image carrier member cleaning means being merged to the single flow channel of the merge.

One implementation of a developer collection system as defined above further comprises: image carrier member cleaning means arranged at the downstream sides of the respective primary transfer sections of the image carrier member in the sense of rotation thereof; and an intermediate transfer member squeezing means arranged at the downstream side of the primary transfer sections of the intermediate transfer member in the sense of moving direction thereof; the flow channel of the developer collected by the image carrier member cleaning means and the flow channel of the developer collected by the intermediate transfer member squeezing means being merged to a single flow channel; the single flow channel of the merge being further merged with the flow channels of the developers collected by the downstream image carrier member squeezing means.

In one implementation of in a developer collection system as defined above, the secondary transfer means includes a transfer roller for transferring the development image onto a sheet and a cleaning blade held in contact with the roller and the flow channel of the developer collected by the intermediate transfer member squeezing means and the flow channels of the developers collected by the image carrier member squeezing means are merged to a single flow channel, the single collection flow channel of the merge being further merged with the flow channel of the developer collected by the cleaning blade.

In one implementation of a developer collection system as defined above, the collection flow channel is linked to the carrier buffer tank by way of the filter and the carrier contained in the carrier buffer tank is distributed to the plurality of development means for recycling.

Another embodiment of the invention is a developer collection system comprising: a plurality of image carrier members; a plurality of development means for developing the electrostatic latent images formed respectively on the plurality of image carrier members by means of liquid developers of different colors containing a non-volatile solvent as carrier; an intermediate transfer member for sequentially transferring the developer images developed by the primary transfer sections respectively corresponding to the plurality of image carrier members, superposing them one on the other and carrying and conveying the developer images; and a secondary transfer means for transferring the superposed developer images from the intermediate transfer member onto a sheet on a sheet conveyance route in the secondary transfer section; developer collection means including image carrier member squeezing means arranged at the upstream sides relative to the respective primary transfer sections of the image carrier members in the sense of rotation and an intermediate transfer member squeezing means arranged at the downstream side of the intermediate transfer member relative to the respective primary transfer sections; the developers collected from the intermediate transfer member squeezing means except the intermediate transfer member squeezing means arranged at the most downstream in the sense of the moving direction of the intermediate transfer member and the developers collected from the image carrier member squeezing means arranged at the downstream sides of the respective intermediate transfer member squeezing means in the sense of the moving direction of the intermediate transfer member are collected in a single developer collection section.

One implementation of a developer collection system as defined above further comprises image carrier member cleaning means arranged at the downstream sides of the respective image carrier members relative to the respective primary transfer sections as developer collection means; flow channels of the developers collected by the developer collecting sections of the image carrier member cleaning means arranged at the upstream sides of the intermediate transfer member relative to the respective intermediate transfer squeezing means and the flow channel of the developer collected in the single developer collecting section being merged to a single flow channel.

One implementation of a developer collection system as defined above further comprises an intermediate transfer member cleaning means arranged at the downstream side of the intermediate transfer member relative to the secondary transfer section in the sense of the moving direction thereof and at the upstream side relative to the primary transfer section of the first color in the sense of die moving direction thereof and the flow channel of the developer collected in the developer collecting section of the intermediate transfer member cleaning means and the flow channel of the developer collected in the developer collecting section of the image carrier member squeezing means of the first color are merged to a single flow channel.

In one implementation of a developer collection system as defined above, the secondary transfer means includes a transfer roller for transferring the developer image onto a sheet and a cleaning blade held in contact with the transfer roller and the flow channel of the developer collected from the cleaning blade is merged to the single flow channel.

In one implementation of a developer collection system as defined above, the developer of the single flow channel of the merge is conveyed to a carrier buffer tank by way of a filter means to separate the carrier by means of the filter means and store the carrier in the carrier buffer tank and a developer conveyance means is provided to distribute the carrier stored in the carrier buffer tank from the carrier buffer tank to the plurality of development means.

Another embodiment of the invention is a developer collection system comprising: a plurality of image carrier members; a plurality of development means for developing the electrostatic latent images formed respectively on the plurality of image carrier members by means of liquid developers of different colors containing a non-volatile solvent as carrier; an intermediate transfer member for sequentially transferring the developer images developed by the primary transfer sections respectively corresponding to the plurality of image carrier members, superposing them one on the other and carrying and conveying the developer images; and a secondary transfer means for transferring the superposed developer images from the intermediate transfer member onto a sheet on a sheet conveyance route in the secondary transfer section; developer collection means including image carrier member cleaning means arranged respectively at the downstream sides of the image carrier members relative to the primary transfer sections in the sense of the moving directions thereof and intermediate transfer member squeezing means arranged at the downstream side of the intermediate transfer member relative to the primary transfer sections in the sense of the moving direction thereof; the developer from the image carrier member cleaning means and the developer from the intermediate transfer member squeezing means being collected in a single developer collecting section.

In one implementation of a developer collection system as defined above, each of the plurality of development means includes a developer container for containing liquid developer, a developer cartridge for supplying developer containing toner to a high concentration in a dispersed state and a carrier cartridge for supplying carrier to the developer container and the developer collected in the single developer collecting section is distributed to the carrier cartridges.

One implementation of a developer collection system as defined above further comprises image carrier member squeezing means arranged respectively at the downstream sides of the image carrier members relative to the primary transfer sections in the sense of moving directions thereof and the flow channels of the developers collected by the image carrier member squeezing means are merged to a single flow channel to convey the collected developer to a carrier buffer tank by way of a filter and store it there in order to distribute the stored carrier to the carrier cartridges by way of the developer conveyance routes between the carrier buffer tank and the carrier cartridges.

In one implementation of a developer collection system as defined above, the developer collection means include image carrier member squeezing means arranged respectively at the downstream sides of the image carrier members relative to the primary transfer sections in the sense of the moving directions thereof and the flow channel of the developer collected in the single developer collecting section and the flow channels of the developers collected by the image carrier member squeezing means arranged respectively at the downstream side of the intermediate transfer member relative to the image carrier member squeezing means in the sense of the moving direction thereof are merged to a single flow channel to convey the collected developer to a carrier buffer tank by way of a filter and store it there in order to distribute the stored carrier by way of the developer conveyance routes between the carrier buffer tank and the carrier cartridges.

One implementation of a developer collection system as defined above further comprises carrier containing tank that can be removably fitted in order to contain the excessive carrier stored in the carrier buffer tank.

In one implementation of a developer collection system as defined above, the carrier cartridges and the carrier containing tank are compatible.

Another embodiment of the invention is a developer collection system comprising: a plurality of image carrier members; a plurality of development means for developing the electrostatic latent images formed respectively on the plurality of image carrier members by means of liquid developers of different colors containing a non-volatile solvent as carrier; an intermediate transfer member for sequentially transferring the developer images developed by the primary transfer sections respectively corresponding to the plurality of image carrier members, superposing them one on the other and carrying and conveying the developer images; and a secondary transfer means for transferring the superposed developer images from the intermediate transfer member onto a sheet on a sheet conveyance route in the secondary transfer section; developer collection means arranged respectively at a plurality of positions to collect excessive developer; a first filter being provided at the flow channel of the developer collected by the developer collection means for collecting black developer out of the developer collection means arranged at a plurality of positions, the flow channel of the developers collected by the developer collection means other than the one for collecting black developer being merged to a single flow channel, a second filter being provided at the single flow channel in order to separate the solid of the developer and the carrier by means of the filters.

In one implementation of a developer collection system as defined above, the developer collection means include image carrier member squeezing means arranged respectively at the upstream sides of the image carrier members relative to the primary transfer sections in the sense of the moving directions thereof, image carrier member cleaning means arranged respectively at the downstream sides of the image carrier members relative to the primary transfer sections in the sense of the moving directions thereof and intermediate transfer member squeezing means arranged at the downstream side of the intermediate transfer member relative to the respective primary transfer sections.

In one implementation of a developer collection system as defined above, the developer collection means for collecting black developer includes the image carrier member squeezing means and the image carrier member cleaning means arranged along the moving direction of the black image carrier member.

In one implementation of a developer collection system as defined above, the developer collection means is the intermediate transfer member cleaning means arranged at the downstream side of the intermediate transfer member relative to the secondary transfer section in the sense of the moving direction thereof and at the upstream side of the intermediate transfer member relative to the primary transfer section of the first color in the sense of the moving direction thereof.

In one implementation of a developer collection system as defined above, the developer collection means is a cleaning means of the transfer roller for transferring the developer image of the secondary transfer means to a sheet.

In one implementation of a developer collection system as defined above, the carrier separated from the solid by way of the filters is conveyed to the carrier buffer tank and stored in the carrier buffer tank and the carrier stored in the carrier buffer tank is distributed to the plurality of development means by way of the developer conveyance routes between the carrier buffer tank and the plurality of development means.

In one implementation of a developer collection system as defined above, each of the plurality of development means includes a developer cartridge and a carrier cartridge respectively containing developer showing a high toner concentration and carrier and adapted to be removably fitted to the corresponding developer container and carrier is distributed from the carrier buffer tank to the carrier cartridges.

In one implementation of a developer collection system as defined above, each of the developer conveyance routes is provided with a carrier containing tank that can be removably fitted to the developer conveyance route in order to contain excessive carrier to be stored in the carrier buffer tank.

In one implementation of a developer collection system as defined above, each of the carrier cartridges and the corresponding carrier containing tank are compatible.

Another embodiment of the invention is an image forming apparatus realized by using a developer collection system as defined above.

Thus, according to the present invention, developer is collected by a single configuration from various components of an image forming apparatus including the image carrier members, the intermediate transfer member and the transfer sections and the collected developers are collectively conveyed. Then, the carrier is separated form the developer by means of one or more than one filters and distributed to the development apparatus to make it possible to achieve a uniform carrier recycling ratio on a stable basis. Developer showing a color mixing phenomenon and/or containing paper dust can be conveyed and the foreign objects can be removed by filtering. Thus, it is possible to collect developer, remove color mixing of the developer and convey the refined developer to the development apparatus for recycling. In other words, it is possible to maintain developer in a desired condition for forming images on a stable basis.

DETAILED DESCRIPTION OF THE PREFERRED EMBODIMENTS

Figure 1:
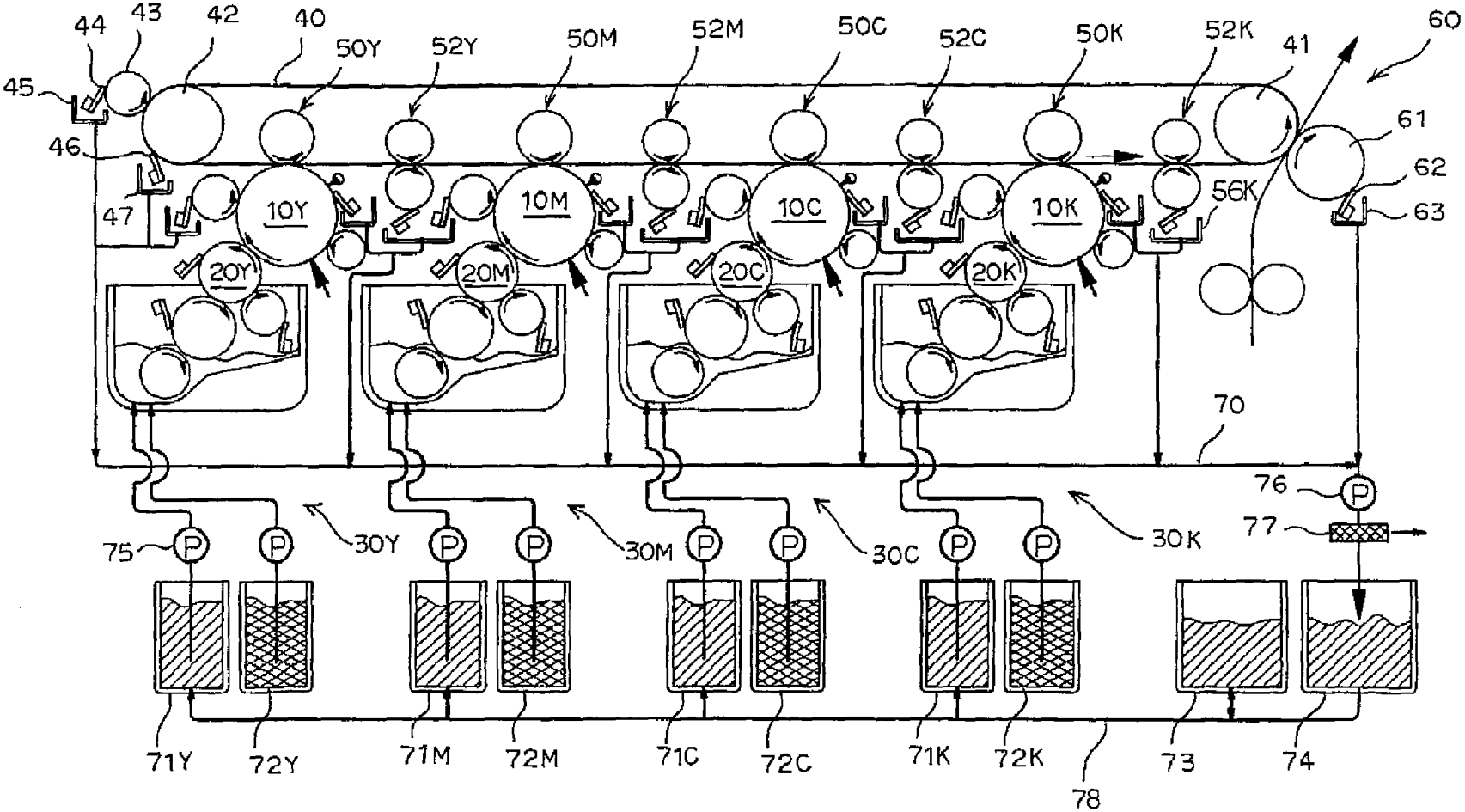
FIG. 1 is a schematic illustration of the first embodiment of developer collection system, showing principal components thereof.
Figure 2:
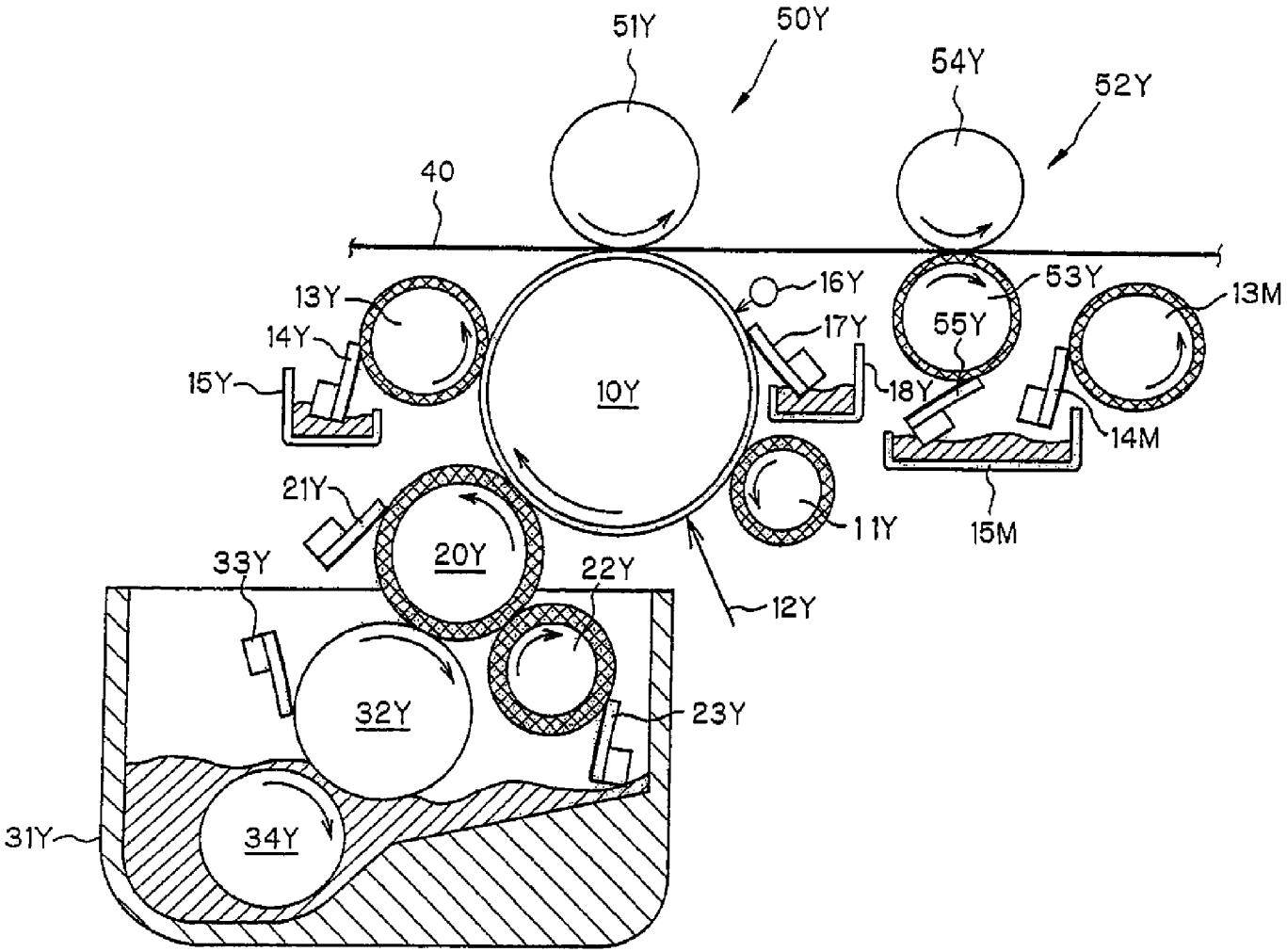
FIG. 2 is a schematic cross sectional view of principal components of one of the image forming sections, the corresponding one of the development units and the intermediate transfer member squeezing apparatus of the first embodiment.

Now, the present invention will be described in greater detail by referring to the accompanying drawings that illustrate preferred embodiments of the invention. FIG. is a schematic illustration of the first embodiment of developer collection system, showing principal components thereof. FIG. 2 is a schematic cross sectional view of principal components of one of the image forming sections, the corresponding one of the development units and the intermediate transfer member squeezing apparatus of the first embodiment. As shown in FIG. 1, an image forming section, a development unit and an intermediate transfer member squeezing apparatus are provided for each of the colors of yellow (Y), magenta (M), cyan (C) and black (B). The same components are denoted by a same reference symbol and differentiated by affixes of Y, M, C and K that represents the respective colors. FIG. 2 shows the configuration of the image forming section, the development unit and the intermediate transfer member squeezing apparatus of yellow (Y). Now, the image forming sections, the development units and the intermediate transfer member squeezing apparatus of the four colors will be described in detail below by referring to FIG. 2.

A cleaning apparatus including a latent image eraser 16Y, an image carrier member cleaning blade 17Y and a developer collecting section 18Y, a charging roller 11Y, an exposure unit 12Y, a development roller 20Y belonging to development unit 30Y and another cleaning apparatus including an image carrier member squeezing roller 13Y, a cleaning blade 14 that is an auxiliary member of the image carrier member squeezing roller 13Y and a developer collecting section 15Y are arranged in the yellow image forming section along the rotation direction (moving direction) of the outer periphery of the image carrier member 10Y. In the development unit 30Y, a cleaning blade 21Y, a developer supply roller 32Y formed by using an ANILOX roller, a regulation blade 33Y for regulating the rate of supply of the developer, a developer compressing roller 22Y and a cleaning blade 23Y for scraping off and removing the developer on the surface of the developer compressing roller 22Y are arranged along the outer periphery of the development roller 20Y, while a developer agitation roller 34Y for agitating the developer in the developer container (reservoir) 31Y containing the liquid developer into a uniformly dispersed state is arranged in the container 31Y. A primary transfer roller 51Y of the primary transfer section 50Y is arranged at the position opposite to the image carrier member 10Y with the intermediate transfer member 40 interposed between them and an intermediate transfer member squeezing apparatus 52Y is arranged at the downstream side of the intermediate transfer member 40 in the sense of the moving direction thereof. The primary transfer sections 50 of the other colors (M, C, K) and the intermediate transfer member squeezing apparatus 52 of the other colors (M, C, K) are arranged further downstream. The intermediate transfer member squeezing apparatus 52Y include an intermediate transfer member squeezing roller 53Y, a backup roller 54Y, an intermediate transfer member squeezing roller cleaning blade 55Y and a developer collecting section 15M.

The liquid developer contained in the developer container 31Y is not a conventional popular liquid developer containing Isopar (tradename, available from Exxon), which is a low concentration (about 1 to 2 wt %), low viscosity and volatile solvent that is volatile at room temperature, as carrier but liquid developer containing a high concentration, high viscosity and non-volatile solvent that is non-volatile at room temperature. More specifically, the liquid developer of this embodiment is a high viscosity (about 30 to 10,000 mPa·s) liquid developer showing a solid toner concentration of about 25% and prepared by adding a particulate solid substance obtained by dispersing a coloring material such as a pigment with an average particle diameter of 1 μm into a thermoplastic resin material to a liquid solvent such as an organic solvent, silicon oil, mineral oil or edible oil with a dispersant. The liquid developer contained in the developer container 31Y is prepared by supplying a developing agent containing toner to a high concentration of about 35 to 55% by weight from a developer cartridge 72Y and a carrier from a carrier cartridge 71Y to the developer container 31Y and agitating them by means of a liquid developer agitation roller 34Y to produce a uniformly dispersed developer containing the carrier and the toner respectively by 75% to 25% by weight so as to regulate the developer concentration that changes as the image on the image carrier member is developed.

In the image forming section and the development unit 30Y, the image carrier member 10Y is uniformly charged by means of the charging roller 11Y and irradiated with a laser beam that is modulated according to the input video signal by means of the exposure unit 12Y having an optical system including a semiconductor laser, a polygon mirror and an F-θ lens so as to form an electrostatic image on the charged image carrier member 10Y. Then, the electrostatic image formed on the image carrier member 10Y is developed by supplying the liquid developer of the color (yellow in this instance) from the developer container 31Y containing the liquid developer, to the development roller 20Y by way of the developer supply roller 32Y, while regulating the rate of supplying the developer by means of the regulation blade 33Y.

The intermediate transfer member 40 is an elastic endless belt member that is wound around and extended between a drive roller 41 and a tension roller 42 and driven to turn round by the drive roller 41, while it is being held in contact with the image carrier members 10Y, 10M, 10C and 10K that are arranged respectively in the primary transfer sections 50Y, 50M, 50C and 50K. In the primary transfer sections 50Y, 50M, 50C and 50K, the primary transfer rollers 51Y; 51M, 51C and 51K are arranged opposite to the respective image carrier members 10Y, 10M, 10C and 10K to pinch the intermediate transfer member 40 between them. Thus, the positions where the primary transfer rollers 51Y, 51M, 51C and 51K contact the respective image carrier members 10Y, 10M, 10C and 1OK are transfer positions and the developed toner images of the colors on the image carrier members 10Y, 10M, 10C and 10K are sequentially transferred onto the intermediate transfer member 40 and laid one on the other to produce a full color toner image. The toner images formed on the plurality of image carrier members 10Y, 10M, 10C and 10K are sequentially transferred onto the intermediate transfer member 40 as primary transfers and laid one on the other. Then, they are collectively transferred onto a sheet as secondary transfer. In other words, a full color toner image is transferred onto a sheet as secondary transfer. An elastic belt member is employed for the intermediate transfer member 40 to transfer a full color toner image onto a sheet in the secondary transfer process because it can follow the surface profile of the sheet if the surface of the sheet is not flat and smooth because of the fibrous texture of the sheet and improve the secondary transfer characteristics of the embodiment.

In the secondary transfer unit 60, a secondary transfer roller 61 is arranged opposite to the belt drive roller 41 to pinch the intermediate transfer member 40 between them and a cleaning apparatus that includes a secondary transfer roller cleaning blade 62 and a developer collecting section 63 is provided. In the secondary transfer unit 60, a sheet that may be made of paper, film or cloth is transferred and supplied to the secondary transfer unit 60 by way of a sheet conveyance route L at the timing that matches the arrival of the toner image, which may be a full color toner image formed by laying colors on the intermediate transfer member 40 or a monochromatic toner image, to the transfer position of the secondary transfer unit 60 and the full color toner image or the monochromatic toner image is transferred onto the sheet in the secondary transfer process. A fixation unit (not shown) is arranged at a forward position on the sheet conveyance route L, where the monochromatic toner image or the full color image transferred onto the sheet is fixed to complete the operation of forming an image on the sheet. An elastic roller that is coated with an elastic material is employed for the secondary transfer roller 61 to transfer a toner image onto a sheet in the secondary transfer process because it can follow the surface profile of the sheet if the surface of the sheet is not flat and smooth because of the fibrous texture of the sheet and improve the secondary transfer characteristics of the embodiment as in the case of the elastic belt of the intermediate transfer member 40 where the toner images formed on the plurality of image carrier members 10Y are sequentially transferred and laid one on the other so as to collectively transfer the toner images on a sheet.

At the side of the tension roller 42 bearing the intermediate transfer member 40 that is would around and extended between it and the belt drive roller 40, the developer compressing roller 43 is arranged opposite to it so as to contact the intermediate transfer member 40 along the outer periphery thereof. A cleaning apparatus including a cleaning blade 46 and a developer collecting section 47 is arranged at the downstream side of the developer compressing roller 43 in the sense of the moving direction of the intermediate transfer member 40. A cleaning apparatus including a cleaning blade 44 and a developer collecting section 45 is arranged at the outer periphery of the developer compressing roller 43 to apply a bias voltage to the developer compressing roller 43 to drive the residual toner on the intermediate transfer member 40 toward the intermediate transfer member 40. After passing the secondary transfer unit 60, the intermediate transfer member 40 proceeds to the tension roller 42, where the developer on the intermediate transfer member is compressed by the developer compressing roller 43, and the surface of the intermediate transfer member 40 is cleaned by the cleaning blade 46. Thereafter, the intermediate transfer member 40 moves toward the primary transfer section 50 once again.

In the developer container 31Y, the toner particles in the liquid developer have a positive electric charge and the developer is agitated by the agitation roller 34Y into a uniformly dispersed state. Then, as the developer supply roller 32Y is rotated, the developer is scooped up from the developer container 31Y and the rate of supply is regulated by the regulation blade 33Y before it is supplied to the development roller 20Y. While the developer stored in the developer container 31Y is in a uniformly dispersed state with the toner weight ratio of about 25% relative to the carrier in the developer in the initial stages, the toner is consumed at a high rate when the image forming duty is high for developing the latent image on the image carrier member 10Y, whereas the toner is consumed at a low rate when the image forming duty is low. In other words, the toner weight ratio in the developer stored in the developer container 31Y changes incessantly as the development process proceeds on the image carrier member 10Y so that it is necessary to constantly monitor the change in the toner weight ratio and control the toner under the condition where it is dispersed and the toner weight ratio is held to about 25%.

Each development unit 30 is provided with a transmission type photo-sensor (not shown) for sensing the dispersed toner weight ratio or a torque sensing means (not shown) for sensing the agitation torque of the developer agitation roller 34 and a reflection type photo-sensor (not shown) for sensing the liquid surface of the developer in the developer container 31 along with other devices as means for sensing the concentration of the developer in the developer container 31. When the dispersed toner weight ratio is reduced in a predetermined quantity of developer, a developer containing dispersed toner to a high concentration of about 35 to 55% is supplied by a necessary quantity from the developer cartridge 72 to the developer container 31. When, on the other hand, the dispersed toner weight ratio is raised, a carrier is supplied from the carrier cartridge 71 to the developer container 31 by a necessary quantity. Thus, the toner weight ratio is controlled and held to about 25% by such supply operations. It is also possible to control the concentration of the developer by means of a controller (CPU) for controlling video signals by predicting the quantity of developer to be supplied from the developer cartridge 72 and the quantity of carrier to be supplied from the carrier cartridge 71 according to the density of the image to be output. The responsiveness and the reliability of controlling the developer can be improved by such a prediction/control method.

Thus, with the developer collection system of this embodiment, a developer containing dispersed toner to a high concentration is supplied from the developer cartridge 72 or a carrier is supplied from the carrier cartridge 71 to the developer container 31 depending on the developer concentration that changes as the development process proceeds on the image carrier member so as to uniformly disperse toner in the carrier with a weight ratio of about 75% versus 25% in favor of the carrier. However, the toner weight ratio in the liquid developer is preferably raised to about 40% to 60% in the final step (not shown) of transferring the image formed by way of various processing steps and by means of the developer onto a sheet and fixing the image from the viewpoint of realizing the secondary transfer feature and the fixing feature in a desired manner. For this purpose, the image carrier member squeezing apparatus (13 through 15), the image carrier member cleaning apparatus (17, 18), the intermediate transfer member squeezing apparatus (52 through 55), the intermediate transfer member cleaning apparatus (42 through 47) and the secondary transfer roller cleaning apparatus (62, 63), each having a cleaning blades as described above, are provided as so-called developer collection means for removing and collecting the excessive developer and the excessive carrier at a plurality of positions. The cleaning blades include the cleaning blade 14Y of the image carrier member squeezing roller 13Y, the cleaning blade 17Y of the image carrier member 10Y, the cleaning blade 55Y of the intermediate transfer member squeezing apparatus 52Y, the cleaning blade 62 of the secondary transfer roller 61, the cleaning blade 44 of the intermediate transfer member developer compression roller 43 and the cleaning blade 46 of the intermediate transfer member 40.

In this embodiment, the flow channel of the developer scraped off and collected by the cleaning blade 14Y and collected in the developer collecting section 15Y, the flow channel of the developer scraped off by the cleaning blade 44 and collected in the developer collecting section 45 and the flow channel of the developer scraped off by the cleaning blade 46 and collected in the developer collecting section 47 for the first color are merged to a single flow channel. Then, the flow channel of the developer scrapped off by the cleaning blade 17Y and collected in the developer collecting section 18Y and the flow channel of the developer scraped off by the cleaning blade 55Y and the developer of the next color scraped off by the cleaning blade 14M and collected in the developer collecting section 15M are merged to a single flow channel. For the second color and the subsequent colors, the flow channels of the collected developers are merged to a single flow channel in a similar manner. Finally, the flow channel of the developer of the fourth color scraped off by the cleaning blade 17K and collected in the developer collecting section 18K and the flow channel of the developer scraped off by the cleaning blade 55K and collected in the developer collecting section 56K are merged to a single flow channel. Then, the merged flow channels and the flow channel of the developer scraped off by the cleaning blade 62 and collected in the developer collecting section 63 are further merged to a developer collection flow channel 70 and conveyed from a pump 76 to a filter means 77.

Thus, the developers scraped off and collected by the cleaning blades are conveyed from the merged collection flow channel 70 and stored in carrier buffer tank 74 by way of the filter 77 so that they may be recycled. When the developers used for development by the plurality of development units are collected, they show the color mixing phenomenon so that they cannot be recycled in the condition as they are. Therefore, the filter means 77 is provided on the conveyance route to filter the toner particles so that only the carrier may be recycled. The carrier stored in the carrier buffer tank 74 is reused as it is distributed to the carrier cartridges 71 by way of the developer conveyance route 78 and then supplied from the carrier cartridges 71 while the developers are supplied respectively from the developer cartridges 72 to the developer containers (reservoirs) 31.

The filter means 77 separates the solid toners and the paper dust contained in the developers from the carrier after the flow channels of the developers collected by the developer collection means are merged. A paper filter, an electrostatic filter or some other filter may be used for it. The carrier that is separated from the toners and ready for reuse is temporarily stored in the carrier buffer tank 74 before it is distributed to the carrier cartridges of the plurality of development units. With this system arrangement, the carrier recycle ratio can be made uniform among the development units and hence the carrier can be recycled on a stable manner. Thus, the pump 76 for conveying the developers and the filter means 77 can be used commonly for the developers of the different colors to realize a simple system at low cost. The developers collected from the cleaning apparatus of the secondary transfer roller 61 and the intermediate transfer member 40 may contain foreign objects and/or paper dust and hence may well be disposed as waste without recycling from the conventional point of view. However, the filtering step of this embodiment can filter foreign object and paper dust along with solid toners and hence the developers from the related various components can be recycled. The filtering feature of the embodiment can be stably maintained when it is provided with a system of replacing the filter member 77 to remove the toners of mixed colors, the foreign objects and the paper dust caught by the filter member 77 according to the output of a sensing means for sensing the condition of the filter member 77.

When the toner weight ratio of the developer supplied from a developer cartridge 72Y is high, the developer can be relatively short of the carrier. When, on the other hand, the toner weight ratio of the developer supplied from the detector cartridge is low, the carrier can be relatively in excess in the developer. When the developer is short of the carrier, the carrier can additionally be supplied in a simple manner since the carrier cartridge 71Y that is removably arranged on the carrier conveyance route. Besides, not only when the toner weight ratio is low but also when the development process is conducted with a high image forming duty, the toner weight ratio is raised to about 40% to 60% for the secondary transfer and the fixation by supplying a developer showing a toner weight ratio of about 35 to 55% from the developer cartridge 72Y as the developer consumption progresses. Then, the rate at which the carrier is collected rises and the carrier becomes relatively in excess. Thus, since the developer cartridge 72Y contains a developer where the toner is dispersed to show a high concentration and hence a high weight ratio of about 35 to 55%, the carrier becomes relatively in excess as the developer is consumed for a development process of a high image forming duty. In view of this fact, this embodiment is provided with a carrier containing tank 73 that is removably fitted to the embodiment so that it is removed when it is full in addition to the carrier buffer tank 74. With this arrangement, the full carrier containing tank 73 is replaced by an empty carrier containing tank for storage and hence the carrier can be recycled efficiently without being wasted. Then, the carrier buffer tank 74 can be downsized because it is not necessary to provide a carrier buffer tank 74 having an extremely large capacity.

It is possible to omit the carrier cartridges 71 so that the carrier may be directly and appropriately supplied to the developer containers 31 from the carrier buffer tank 74. When the carrier cartridges are arranged on the carrier conveyance route along with the developer cartridges 72 so as to be removably fitted and the carrier cartridges 71 are made compatible with the carrier containing tank 73, any of the carrier cartridges 71 can conveniently be used as carrier containing tank when it becomes empty. While the carrier may be flow in and flow out from the carrier cartridges 71 and the carrier containing tank 73 so as to flow through the carrier conveyance route in opposite directions. This arrangement will be particularly convenient when they are provided with a check valve function to prevent any undesired flow of the carrier and made to be removably fitted.

Each developer may be supplied to the corresponding developer container 31 after being compounded in a compounding bottle arranged separately from the corresponding development unit so as to operate as means for compounding the developer. However, appropriate consideration has to be given in order not to give rise to any time lag in controlling the developer concentration in the developer container 31 that changes incessantly. However, with the arrangement of this embodiment of supplying a highly densely dispersed developer and a carrier into the developer container 31 according to the output of the sensing means for sensing the dispersed toner weight ratio and that of the sensing means for sensing the amount of developer in the development unit, it is possible to supply a highly densely dispersed developer and a carrier into the developer container 31 and agitate them to realize a uniformly dispersed state without any time lag for stably controlling the concentration.

As described above, the developers are scraped off and collected by the cleaning apparatus of the developer collection means and distributed to the development units 30 for recycling. Now, each of the developer collection means will be discussed below. The development unit 30Y has the cleaning blade 23Y for cleaning the developer compressing roller 22Y for compressing the toner of the liquid developer borne by the development roller 20Y and the cleaning blade 21Y for cleaning the developer roller 20Y. The cleaning blade 21Y is arranged at the downstream side relative to the development nip section where the development roller 20Y is held in contact with the image carrier member 10Y in the sense of rotation of the development roller 20Y and adapted to scrape off the developer remaining on the development roller 20Y, whereas the cleaning blade 23Y is adapted to scrape off and remove the developer remaining on the developer compressing roller 22Y that is driven to rotate in the sense of the arrow shown in FIG. 2. The collected developers are put together with the developer in the reservoir 31Y for recycling. The carriers and the toners that are put together do not show any color mixing phenomenon.

The image carrier member squeezing apparatus includes the cleaning blade 14Y that is arranged vis-à-vis the image carrier member 10Y and downstream relative to the development roller 20Y in the sense of rotation and pressed against and held in sliding contact with the image carrier member squeezing roller 13Y for the cleaning purpose and the developer collecting section 15Y. It collects the excessive carrier and the unnecessary fogging toner from the developer used for the development process on the image carrier member 10Y to raise the toner particle ratio in the visible image. In this embodiment, the image carrier member squeezing roller 13Y is driven to rotate with the image carrier member 10Y substantially at the same peripheral speed and the excessive carrier that is about 5 to 10% by weight of the developer used for development on the image carrier member 10Y is collected to reduce the load of driving them to rotate and suppress the turbulence effect of the image carrier member 10Y on the toner image. The excessive carrier and the unnecessary fogging toner collected by the image carrier member squeezing roller 13Y is then collected by the developer collecting section 15Y from the image carrier member squeezing roller 13Y under the effect of the cleaning blade 14Y and pooled. Since the excessive carrier and the fogging toner are collected from the dedicated and isolated image carrier member 10Y and hence no color mixing phenomenon occurs in each of the image forming sections.

In the primary transfer section 50Y, the image carrier member 10Y and the intermediate transfer member 40 are driven to move at the same speed and the developed developer image on the image carrier member 10Y is transferred onto the intermediate transfer member 40 by the primary transfer roller 51Y to reduce the load of rotation and move and suppress the turbulence effect of the image carrier member 10Y on the visible toner image. No color mixing phenomenon occurs in the primary transfer section 50Y of the first color because the first primary transfer takes place there. However, for each of the second color and the subsequent colors, a toner image is transferred and laid on the toner image that has already been transferred so that the reverse transfer toner that arises due to the so-called reverse transfer phenomenon where the toner moves from the intermediate transfer member 40 to the image carrier member 10 (M, C or K) and the toner remaining after the transfer are mixed and borne by the image carrier member 10 (M, C or K) with the excessive carrier to move. Then, the toner is collected from the image carrier member under the effect of the cleaning blade 17 (M, C or K) and pooled.

The desirable dispersed state of the developer (the toner dispersed in the carrier) in the final step (not shown) of transferring the image formed by way of various processing steps and by means of the developer onto a sheet and fixing the image is such that the toner weight ratio in the liquid developer is preferably raised to about 40% to 60% from the viewpoint of realizing the secondary transfer feature and the fixing feature in a desired manner as pointed out above. The intermediate transfer member squeezing apparatus 52Y is provided as means for further removing the excessive carrier from the intermediate transfer member 40 when the developer is not in the desirable dispersed state in the final step. The intermediate transfer member squeezing apparatus 52Y is arranged at the downstream side of the intermediate transfer member 40 relative to the primary transfer section 50Y in the sense of the moving direction of the intermediate transfer member 40 and includes the intermediate transfer member squeezing roller 53Y, the backup roller 54Y arranged opposite to the intermediate transfer member squeezing roller 52Y with the intermediate transfer member 40 interposed between them, the cleaning blade 55Y pressed against and held in sliding contact with the intermediate transfer member squeezing roller 53Y to clean the surface thereof and the developer collecting section 15M so as to collect the excessive carrier from the developer transferred onto the intermediate transfer member 40 as primary transfer in order to raise the toner particle ratio in the visible image and collect the unnecessary fogging toner. The developer collecting section 15M operates as the collection mechanism of the carrier collected by the cleaning blade 14M of the magenta image carrier member arranged at the downstream side in the sense of the moving direction of the intermediate transfer member 40 and also as the collection mechanism of the carrier collected by the cleaning blade 55Y of the intermediate transfer member squeezing roller 53Y. As the developer collecting section 15 (M, C and K) of each of the second color and the subsequent colors operates as the developer collecting section of the intermediate transfer member squeezing apparatus 52 (Y, M and C) arranged at the downstream side in the sense of the moving direction of the intermediate transfer member 40 relative to the primary transfer section 50 (Y, M, and C) of the immediately preceding color, the gaps separating the developer collecting sections 15 can be controlled to be a constant value. Then, the embodiment can be made to have a simplified structure and downsized.

No color mixing phenomenon occurs at the intermediate transfer member squeezing site of the first color because the first intermediate transfer member squeezing operation takes place there. However, for the second color and the subsequent colors, a toner image is transferred on the toner image that is already transferred as primary transfer and the colors are laid one on the other. Thus, when toner is moved from the intermediate transfer member 40 to the intermediate transfer member squeezing roller 53 of the second or subsequent color, color mixing occurs and toner is borne by the intermediate transfer member squeezing roller 53 with excessive carrier and moved so as to be collected from the intermediate transfer member squeezing roller 53 under the effect of the cleaning blade and pooled. Note that, when the developer squeezing ability of the image carrier member 10 arranged at the primary transfer site at the upstream side of the site where the intermediate transfer member squeezing step takes place and the developer squeezing ability of the image carrier member squeezing roller 53 are sufficient, it is not necessary to arrange all the intermediate transfer member squeezing apparatus 52 at the downstream side in the sense of the moving direction of the intermediate transfer member 40 relative to the primary transfer site.

A sheet is supplied at the timing when the toner image formed on the intermediate transfer member 40 by laying colors one on the other gets to the secondary transfer site and the toner image is transferred onto the sheet as secondary transfer. Then, the sheet is driven to move toward the fixing step, where the process of forming an image on the sheet ends. However, when trouble occurs in the operation of supplying the sheet such as a jammed sheet, all the toner of the toner image may not be transferred onto the secondary transfer roller and collected but the toner may be partly left on the interface transfer member. Additionally, all the toner of the toner image may not be transferred onto the secondary transfer roller and moved onto the sheet by 100% but the toner may be left behind by several percents after the secondary transfer. Particularly, when trouble takes place in the sheet supplying operation such as a jammed sheet, the toner image can be brought into contact with and transferred onto the secondary transfer roller 61 without a sheet interposed between them to consequently stain the rear surface of the sheet. A bias voltage that shows the polarity same as that of the electric charge of the toner particles is applied to the developer compression roller 43 in order to drive the toner particles of the liquid developer of the unnecessary toner image toward the intermediate transfer member 40. The bias voltage that is applied when trouble such as a jammed sheet occurs may alternatively be applied to the secondary transfer roller 61 or the intermediate transfer member squeezing roller 53. With this arrangement, the toner particles of the liquid developer left on the intermediate transfer member 40 are driven toward the intermediate transfer member 40 and brought into a compressed state and the liquid carrier is collected (squeezed) so as to efficiently clean the surface of the intermediate transfer member 40 and that of the secondary transfer roller 61 respectively by the cleaning blade 46 of the intermediate transfer member and the cleaning blade 62 of the secondary transfer roller. Thus, the cleaning blade 62 of the secondary transfer roller is provided as means for removing the developer (the toner dispersed in the carrier) transferred onto the secondary transfer roller 61 and the developer is collected from the secondary transfer roller 61 and pooled. The pooled developer shows a color mixing phenomenon and may contain foreign objects such paper dust. However, they are separated by the filter 77 as described earlier.

Figure 3:
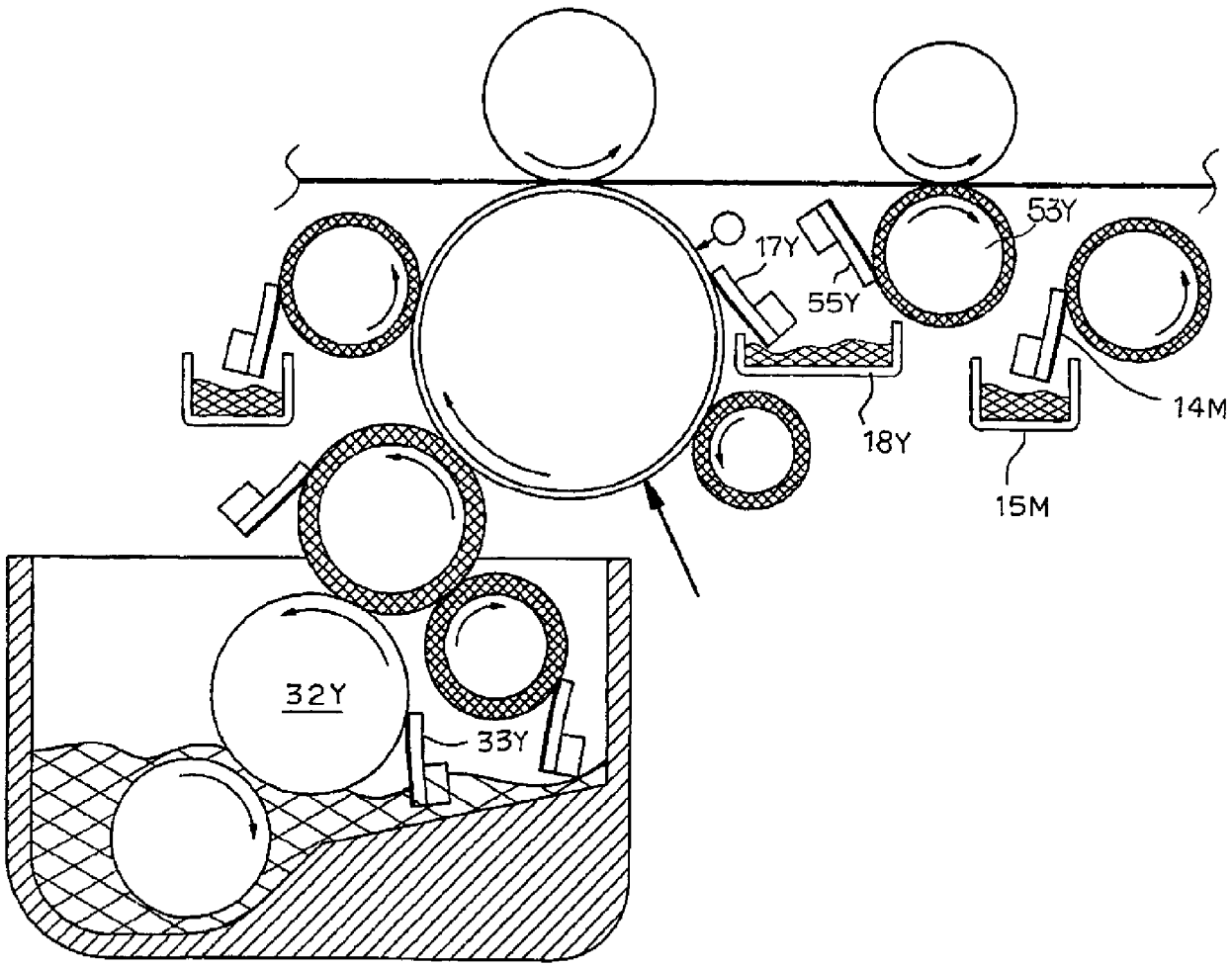
FIG. 3 is a schematic illustration of another embodiment of developer collection system.
Figure 4:
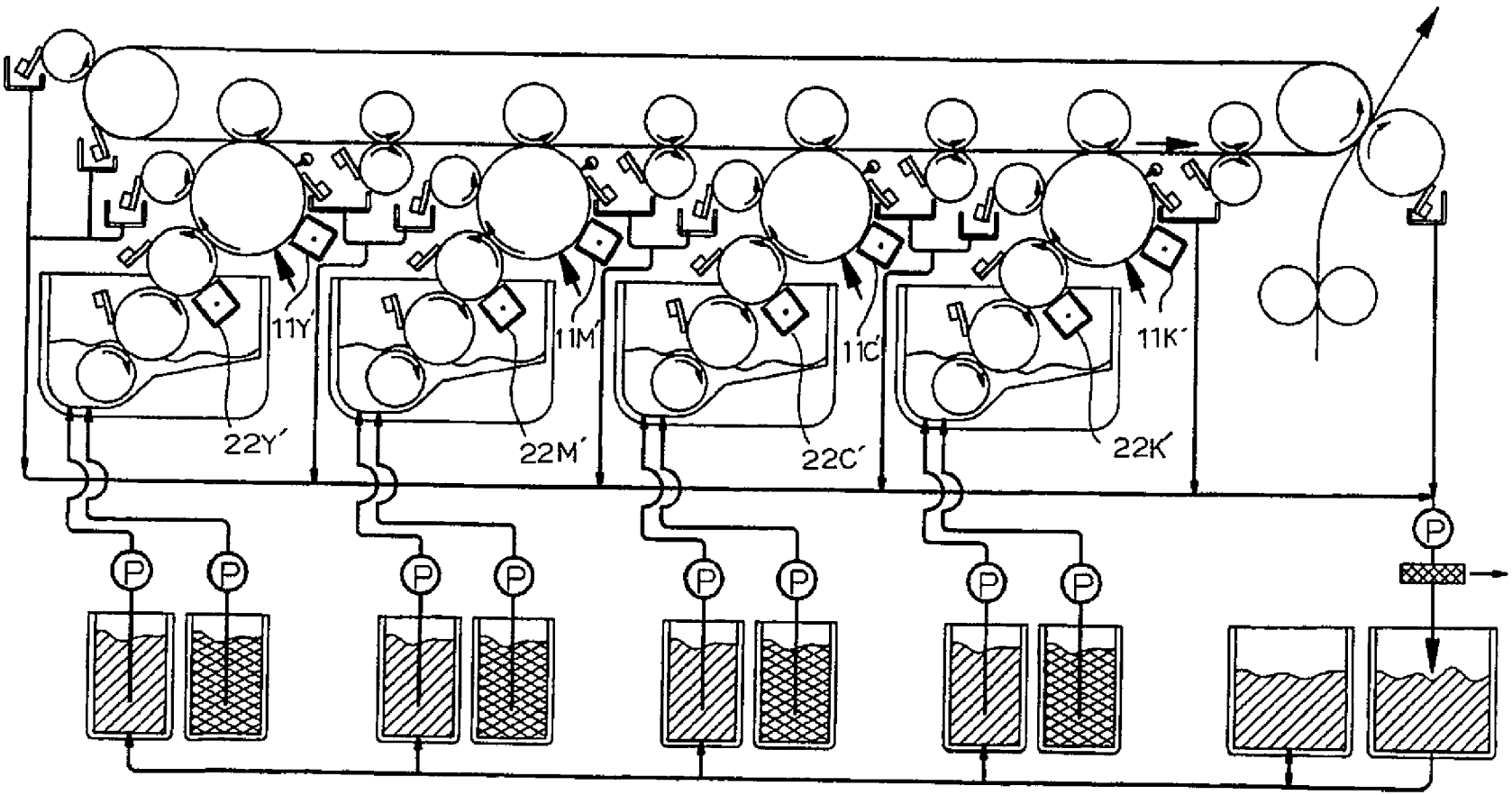
FIG. 4 is a schematic illustration of still another embodiment of developer collection system.

FIG. 3 is a schematic illustration of another embodiment of developer collection system. FIG. 4 is a schematic illustration of still another embodiment of developer collection system. The embodiment of FIG. 3 is realized by reversing the sense of rotation of the developer supply roller 32Y relative to that of the developer supply unit 32Y of FIG. 2 showing the image forming section, the development unit and the intermediate transfer member squeezing apparatus and accordingly arranging the regulation blade 33Y not at the left side but at the right side of the developer supply unit 32Y as shown in FIG. 3, while both the developer scraped off by the cleaning blade 55Y and the developer scraped off by the cleaning blade 17Y of the image carrier member 10Y are collected by the developer collecting section 18Y. With this arrangement, the image forming sections, the development units and the intermediate transfer member squeezing apparatus of the different colors are made independent from each other. Then, the image forming section, the development unit and the intermediate transfer member squeezing aperture of each color can be unitized. Such a unit is very compact. In the first embodiment, the developer scraped off by the cleaning blade 55Y is collected by the developer collecting section 15M that also collects the developer scraped off by the cleaning blade 14M of the image carrier member squeezing roller 13M of the next color and hence the intervals separating adjacent primary transfer sections is reduced to by turn reduce the entire length so as to provide an advantage of making the entire apparatus compact. However, the first embodiment is accompanied by a disadvantage that the intervals separating adjacent primary transfer sections are limited. On the other hand, this arrangement of the image forming section, the development unit and the intermediate transfer member squeezing apparatus of a color is not restricted by that of the other colors in the embodiment of FIG. 3 to raise the freedom of arrangement for each color unit. The embodiment of FIG. 4 is realized by replacing the charging roller 11Y and the developer compressing roller 22Y of FIG. 2 by respective corona dischargers that charge the image carrier member 10Y by corona discharge and drive the toner particles of the developer toward the development roller 20Y to realize a compressed state for the developer.

Figure 5:
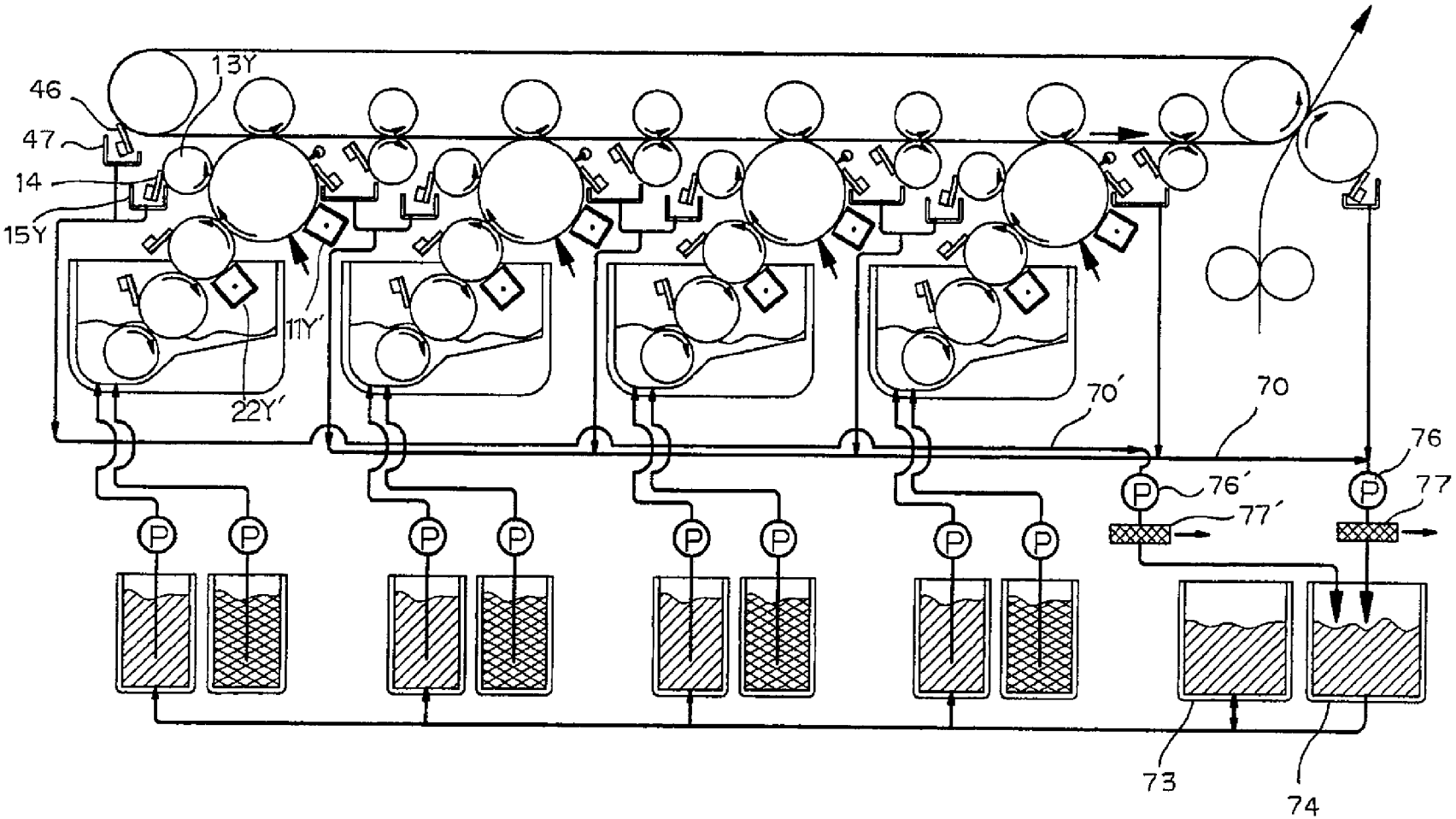
FIG. 5 is a schematic illustration of still another embodiment of developer collection system.

FIG. 5 is a schematic illustration of still another embodiment of developer collection system. In the embodiment of FIG. 5, the flow channel of the developer collected by the image carrier member squeezing apparatus (13Y, 14Y, 15Y) that are arranged at the upstream side of the primary transfer section 50Y of the image carrier member 10Y of the first color and that of the developer collected by the intermediate transfer member cleaning apparatus (46, 47) are merged to a single flow channel and conveyed to the carrier buffer tank 74 by way of a collection flow channels 70', a pump 76' and a filter 77' that are different from those of other collection flow channels 70. Wastes such as paper dust of the sheet are collected with the developer from the intermediate transfer member cleaning apparatus to make the developer less mobile. However, as the developer from the intermediate transfer member cleaning apparatus and the developer from the image carrier member squeezing apparatus of the first color are collected by way of the same flow channel in this way, the developer flowing in the same flow channel is rich in carrier and highly mobile so that it can be collected with ease. Note that, in the embodiment of FIG. 5, the intermediate transfer member cleaning apparatus is arranged at a position that is located downstream relative to the secondary transfer unit 60 but upstream relative to the primary transfer section 50Y of the first color in the sense of the moving direction of the intermediate transfer member 40. Additionally, the charging roller 11Y and the developer compressing roller 22Y of FIG. 2 are replaced by respective corona dischargers 11Y' and 22Y' that charge the image carrier member 10Y by corona discharge and drive the toner particles of the developer toward the development roller 20Y to realize a compressed state for the developer. The developer compressing rollers 43, the cleaning blades 44 and the developer collecting sections 45 of the intermediate transmission member cleaning apparatus of FIG. 1 are omitted in FIG. 5 because they may be omitted without problem.

In the embodiment of FIG. 5, the flow channel of the developer collected by the image carrier member squeezing apparatus (13Y, 14Y, 15Y) that are arranged at the upstream side of the primary transfer section 50Y of the image carrier member 10Y of the first color and that of the developer collected by the intermediate transfer member cleaning apparatus (46, 47) are merged to a single flow channel and conveyed to the carrier buffer tank 74 by way of a collection flow channels 70', a pump 76' and a filter 77' that are different from those of other collection flow channels 70. As pointed out above, wastes such as paper dust of the sheet are collected with the developer from the intermediate transfer member cleaning apparatus to make the developer less mobile. However, as the developer from the intermediate transfer member cleaning apparatus and the developer from the image carrier member squeezing apparatus of the first color are collected by way of the same flow channel in this way, the developer flowing in the same flow channel is rich in carrier and highly mobile so that it can be collected with ease. Note that, in the embodiment of FIG. 5, the intermediate transfer member cleaning apparatus is arranged at a position that is located downstream relative to the secondary transfer unit 60 but upstream relative to the primary transfer section 50Y of the first color in the sense of the moving direction of the intermediate transfer member 40. Additionally, the charging roller 11Y and the developer compressing roller 22Y of FIG. 2 are replaced by respective corona dischargers that charge the image carrier member 10Y by corona discharge and drive the toner particles of the developer toward the development roller 20Y to realize a compressed state for the developer. The developer compressing rollers 43, the cleaning blades 44 and the developer collecting sections 45 of FIG. 1 are omitted in FIG. 5 because they may be omitted without problem.

Figure 6:
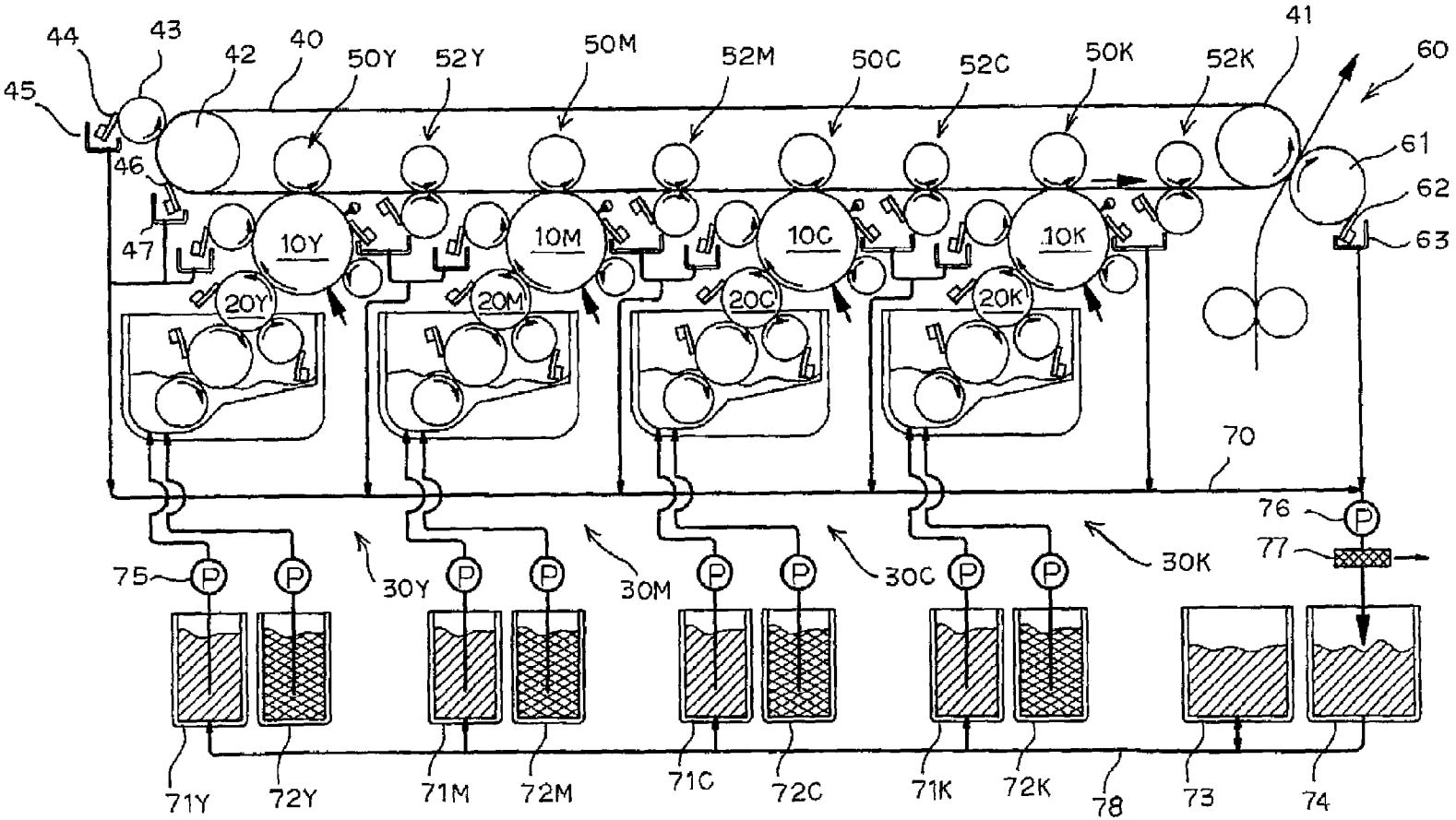
FIG. 6 is a schematic illustration of still another embodiment of developer collection system, showing principal components thereof.
Figure 7:
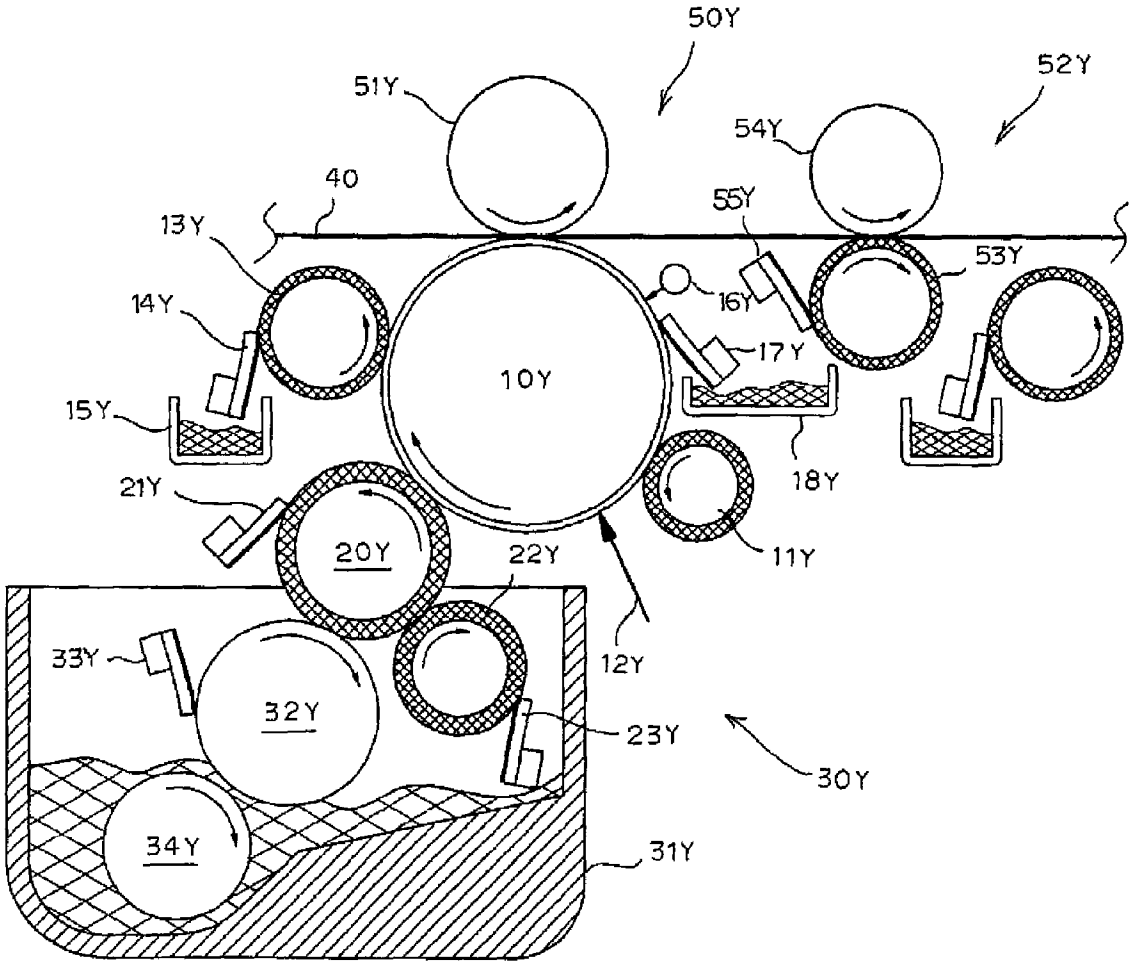
FIG. 7 is a schematic cross sectional view of principal components of one of the image forming sections, the corresponding one of the development units and the intermediate transfer member squeezing apparatus of the embodiment of FIG. 6.

FIG. 6 is a schematic illustration of still another embodiment of developer collection system, showing principal components thereof. FIG. 7 is a schematic cross sectional view of principal components of one of the image forming sections, the corresponding one of the development units and the intermediate transfer member squeezing apparatus of the embodiment of FIG. 6. In FIGS. 6 and 7, the components that are same as those of the first embodiment shown in FIGS. 1 and 2 are denoted respectively by the same reference symbols and will not be described here any further. Thus, only the differences of the two embodiments will be described below.

In the embodiment of FIGS. 6 and 7, the flow channel of the developer of the first color scraped off by the cleaning blade 14Y and collected in the developer collecting section 15Y, the flow channel of the developer scraped off by the cleaning blade 44 and collected in the developer collecting section 45 and the flow channel of the developer scraped off by the cleaning blade 46 and collected in the developer collecting section 47 are merged to a single flow channel. Then, the flow channel of the developer scraped off by the cleaning blades 17Y and the developer scraped off by the cleaning blade 55Y and collected in the developer collecting section 18Y and the flow channel of the developer of the next color scraped off by the cleaning blade 14M and collected in the developer collecting section 15M of the next color are merged to a single flow channel. For the second color and the subsequent colors, the flow channels of the collected developers are merged to a single flow channel in a similar manner. Finally, the merged flow channel and the flow channel of the developer scraped off by the cleaning blade 62 and collected in the developer collecting section 63 are further merged to the developer collecting flow channel 70 and conveyed to the filter means 77 by way of the pump 76.

In FIG. 7, the image carrier member squeezing apparatus is arranged opposite to the image carrier member 10Y at the downstream side relative to the development unit 20Y in the sense of rotation and at the upstream side relative to the primary transfer section 50Y also in the sense of rotation in order to collect the excessive developer of the toner image. It includes the image carrier member squeezing roller 13Y and the cleaning blade 14Y pressed against and held in sliding contact with the image carrier member squeezing roller 13Y to clean the surface of the former and operates to collect the excessive carrier and the unnecessary fogging toner from the developer used for development on the image carrier member 10Y and consequently raise the toner particle ratio in the visible image. In this embodiment, the image carrier member squeezing roller 13Y is driven to rotate with the image carrier member 10Y substantially at the same peripheral speed and the excessive carrier that is about 5 to 10% by weight of the developer used for development on the image carrier member 10Y is collected to reduce the load of driving them to rotate and suppress the turbulence effect of the image carrier member 10Y on the toner image. The excessive carrier and the unnecessary fogging toner collected by the image carrier member squeezing roller 13Y is then collected by the developer collecting section 15Y from the image carrier member squeezing roller 13Y under the effect of the cleaning blade 14Y and pooled. Since the excessive carrier and the fogging toner are collected from the dedicated and isolated image carrier member 10Y and hence no color mixing phenomenon occurs in each of the image forming sections.

The developer collecting section 18Y operates as developer collection mechanism for collecting both the developer collected by the cleaning blade 17Y of the image carrier member 10Y and the developer collected by the cleaning blade 55Y of the intermediate transfer member squeezing roller 53Y.

Figure 8:
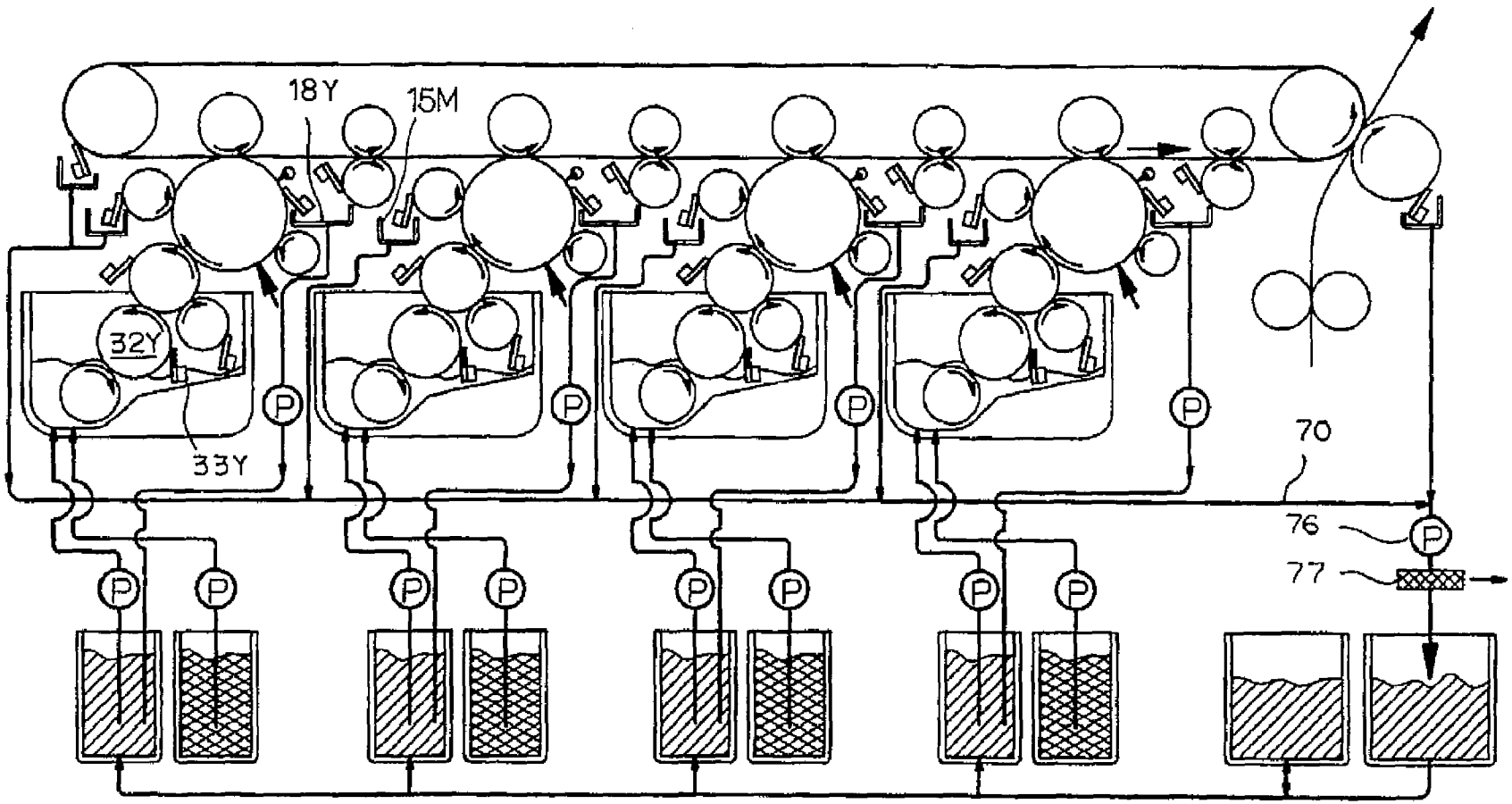
FIG. 8 is a schematic illustration of still another embodiment of developer collection system.
Figure 9:
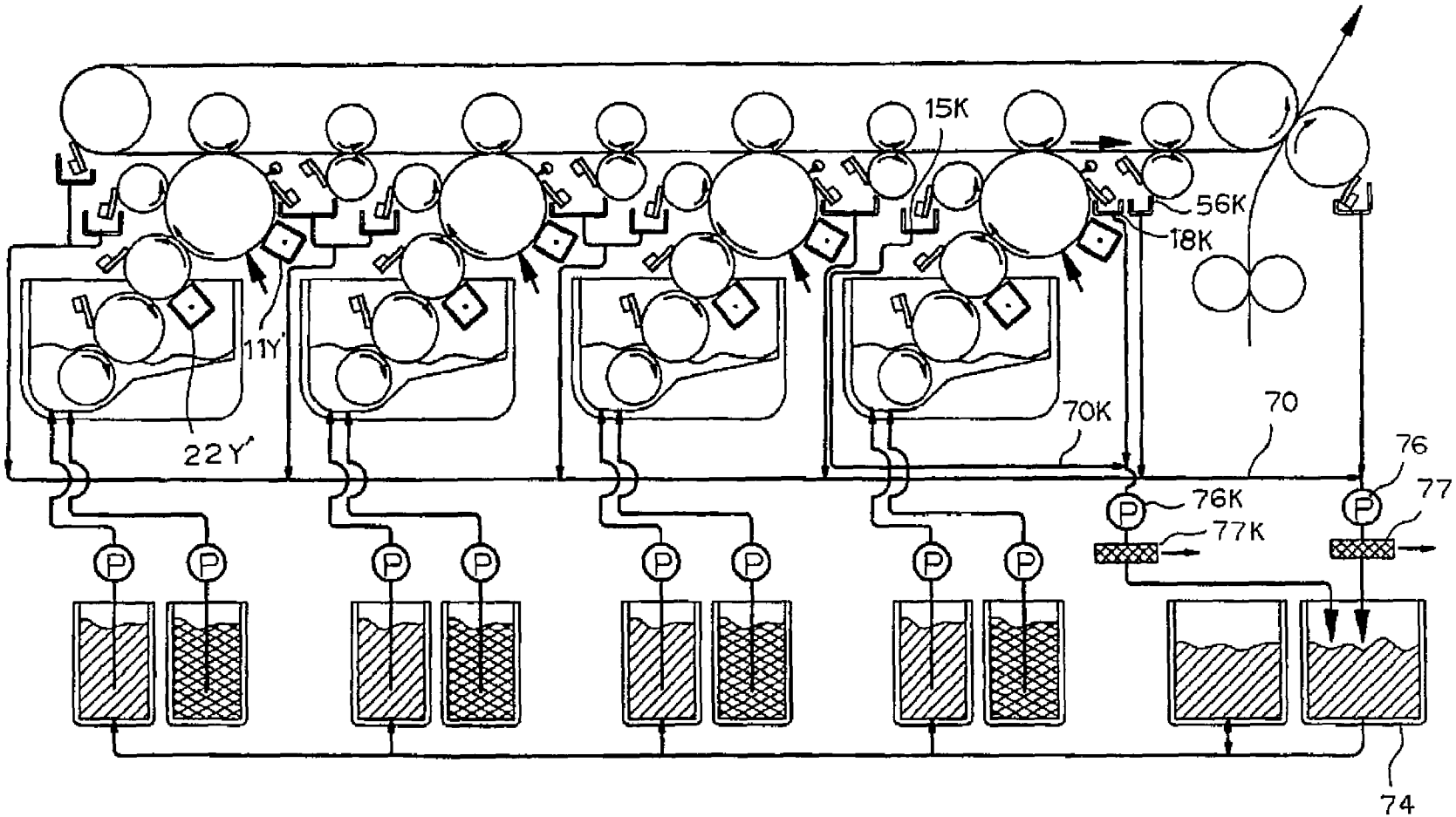
FIG. 9 is a schematic illustration of still another embodiment of developer collection system.

FIG. 8 is a schematic illustration of still another embodiment of developer collection system. FIG. 9 is a schematic illustration of still another embodiment of developer collection system. In the embodiment of FIG. 8, the developer for a yellow image scraped off by the cleaning blade 17Y and the cleaning blade 55Y and collected in the developer collecting section 18Y is then collected in the carrier cartridge 71Y of the development unit 20Y, while the developers of the other colors are collected in the corresponding respective carrier cartridges 71 (M, C, K), for recycling. The flow channels of the developers of the different colors collected in the developer collecting sections (15Y, 15M, 15C, 15K, 47, 63) are merged to the same collection flow channel 70 and conveyed to the carrier buffer tank 74 by way of the pump 76 and the filter 77. A simple flow channel system is realized with this arrangement. Since the overall length of the flow channels is reduced in this embodiment, the pump P may be omitted if the developers are made to mostly fall by their own weights. While the phenomenon of color mixing occurs to a small but increasing extent in the moving direction of the intermediate transfer member 40 toward the downstream from the viewpoint of the second color, the third color and the fourth color, the arrangement of this embodiment is useful when damage to the image quality is allowed to a certain extent. Additionally, the sense of rotation of the developer supply roller 32Y is reversed and accordingly the regulation blade 33Y is shifted from the left side in FIG. 2 to the right side as shown in FIG. 8 along with the other developer supply rollers in this embodiment. This arrangement of the image forming section, the development unit and the intermediate transfer member squeezing apparatus of a color is not restricted by that of the other colors in the embodiment of FIG. 3 to raise the freedom of arrangement for each color unit. The developer compressing rollers 43, the cleaning blades 44 and the developer collecting sections 45 of the intermediate transmission member cleaning apparatus of FIG. 6 are omitted in FIG. 8 because they may be omitted without problem.

In the embodiment of FIG. 9, the developer of the fourth color, or the black color, that is used most frequently because it is normally consumed for monochromatic images, is collected in the carrier buffer tank 74 by way of an independent flow channel 70K that is separated from the flow channel of the developers of the other colors and includes the pump 76 and the filter 77K. While the developer scraped off by the cleaning blade 17K of the image carrier member of the fourth color and the developer scraped off by the cleaning blade 55K of the intermediate transfer member squeezing roller are collected in the respective developer collecting sections 18K, 56K and the flow channels of the developers collected in the developer collecting sections 15K and 18K from the black image carrier member are merged to the collecting flow channel 70K in FIG. 9, the developer scraped off by the cleaning blade 17K and the developer scraped off by the cleaning blade 55K may alternatively be collected in the developer collecting section 18K as in the case of the other colors. Additionally, the charging roller 11Y and the developer compressing roller 22Y of FIG. 7 are replaced by respective corona dischargers 11Y' and 22Y' that charge the image carrier member 10Y by corona discharge and drive the toner particles of the developer toward the development roller 20Y to realize a compressed state for the developer.

Figure 10:
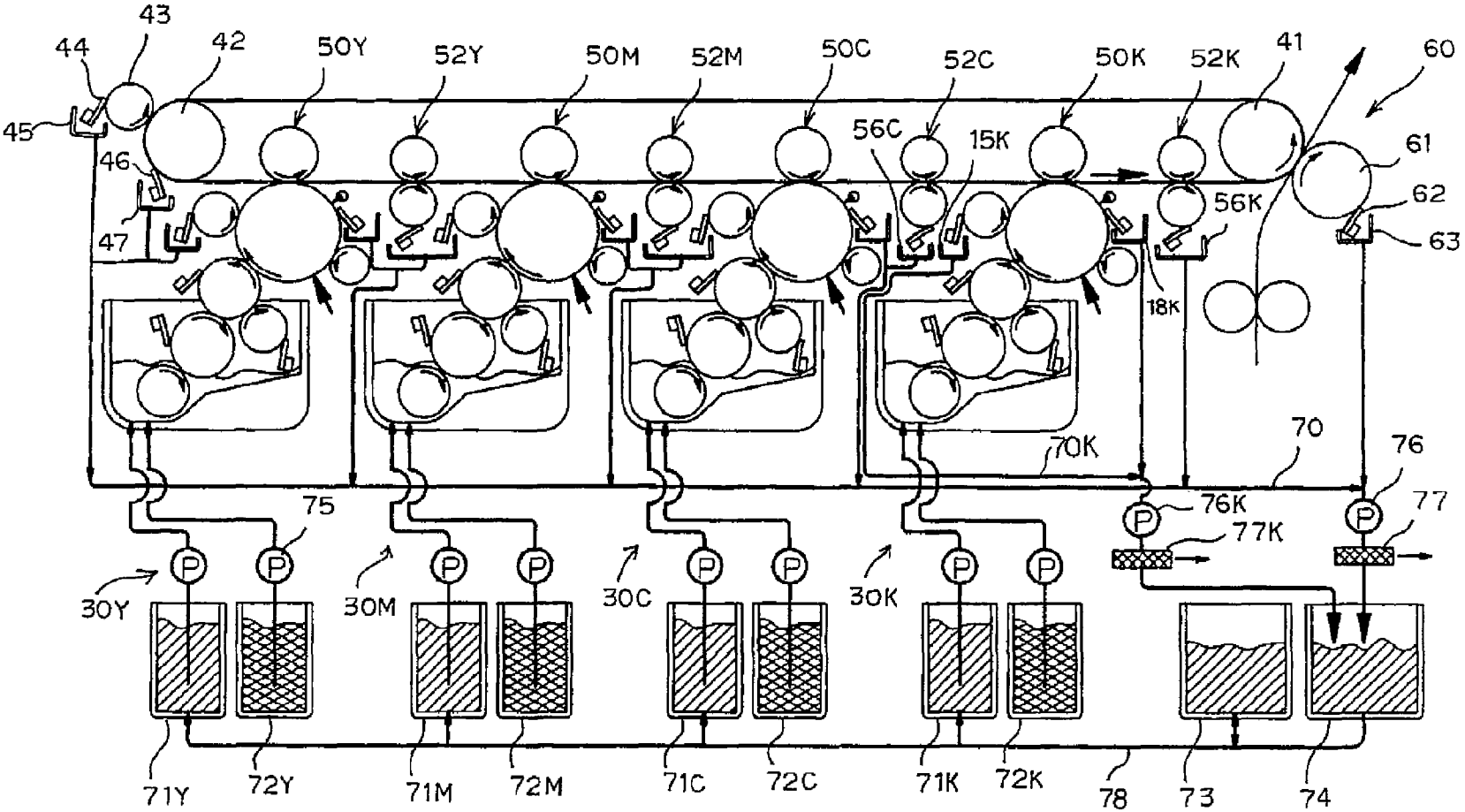
FIG. 10 is a schematic illustration of still another embodiment of developer collection system, showing principal components thereof.
Figure 11:
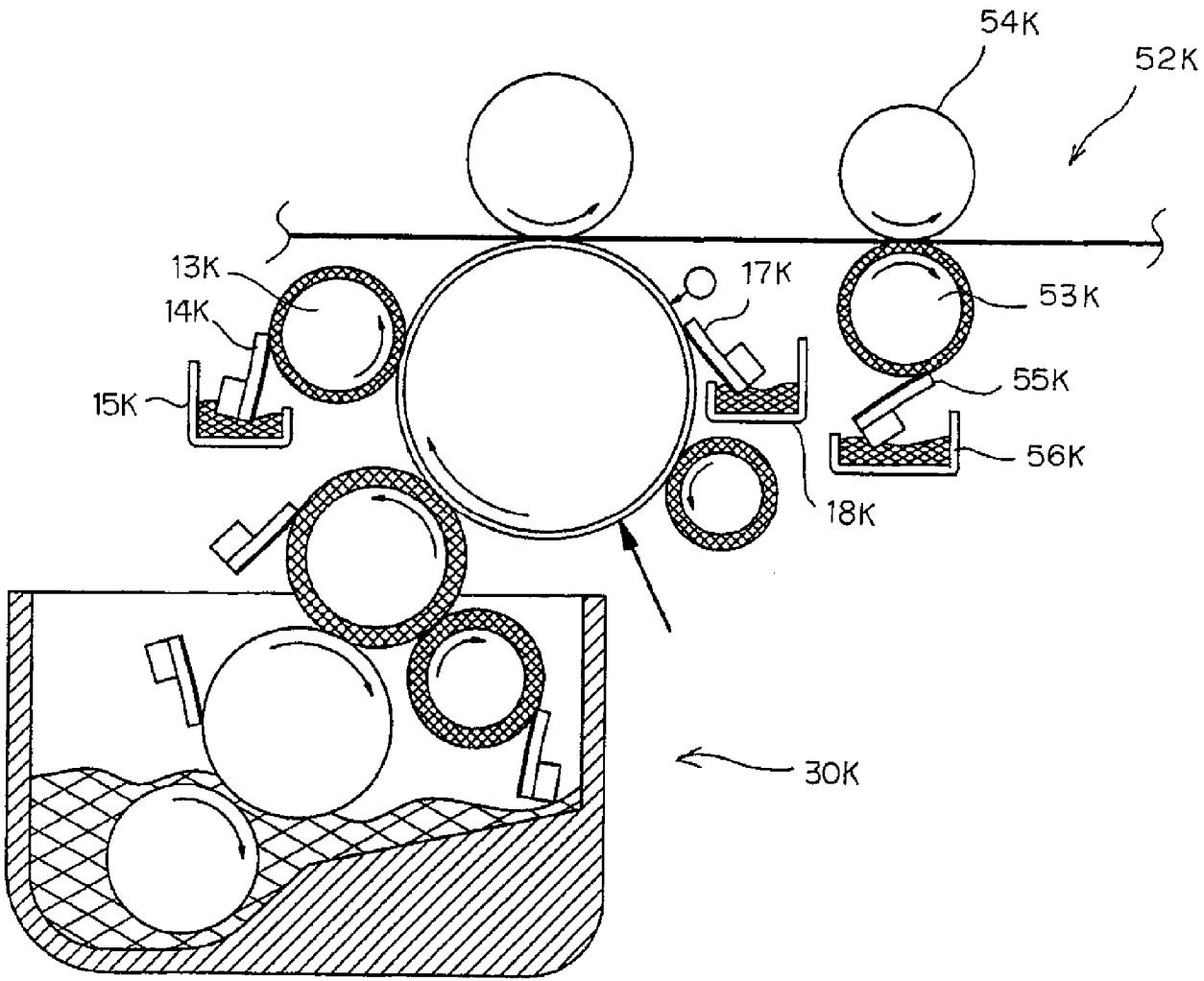
FIG. 11 is a schematic cross sectional view of principal components of the image forming section and the development unit of the black color (K) and the intermediate transfer member squeezing apparatus of the embodiment of FIG. 10.

FIG. 10 is a schematic illustration of still another embodiment of developer collection system, showing principal components thereof. FIG. 11 is a schematic cross sectional view of principal components of the image forming section and the development unit of the black color (K) and the intermediate transfer member squeezing apparatus of the embodiment of FIG. 10. In FIG. 10, an image forming section, a development unit and an intermediate transfer member squeezing apparatus are provided for each of the colors of yellow (Y), magenta (M), cyan (C) and black (B). The same components are denoted by a same reference symbol and differentiated by affixes of Y, M, C and K that represents the respective colors. Now, the image forming sections, the development units and the intermediate transfer member squeezing apparatus of the four colors will be described in detail below by referring to FIGS. 2 and 11.

In FIG. 10, the components that are same as those of the first embodiment are denoted respectively by the same reference symbols and will not be described here any further. Thus, only the differences of the two embodiments will be described below by appropriately referring to FIGS. 2 and 11.

In the embodiment of FIG. 10, while the image forming section, the development unit and the intermediate transfer member squeezing apparatus of magenta (M) and those of cyan (C) are same as their counterparts of yellow (Y), the image forming section, the development unit and the intermediate transfer member squeezing apparatus of the fourth color, or black, are different in that only the developer on the image carrier member squeezing roller is scraped off by the cleaning blade 14K and collected in the developer collecting section 15K and, similarly, only the developer of the intermediate transfer member squeezing apparatus is scraped off by the cleaning blade 55K and collected in the developer collecting section 56K as shown in FIGS. 10 and 11. Accordingly, the developer on the immediately preceding intermediate transfer squeezing apparatus is collected by an independent developer collecting section 56C.

In the embodiment of FIG. 10, for the first color for instance, the flow channel of the developer scraped off by the cleaning blade 14Y and collected in the developer collecting section 15Y, the flow channel of the developer scraped off by the cleaning blade 44 and collected in the developer collecting section 45 and the flow channel of the developer scraped off by the cleaning blade 46 and collected in the developer collecting section 47 are merged to a single flow channel. Then, the flow channel of the developer scraped off the by the cleaning blade 17Y of the developer collecting section 18Y and the developer scraped off by the cleaning blade 55Y and the developer of the next color scraped off by the cleaning blade 14 and collected in the developer collecting section 15M are merged to a single flow channel. For the second color and the third color, the flow channels of the collected developers are merged to a single flow channel in a similar manner. However, the developer scraped off by the cleaning blade 55C of the intermediate transfer member squeezing apparatus 52C arranged downstream relative to the third color is collected in the developer collecting section 56C and the developer of the fourth color scraped off by the cleaning blade 14K of the image carrier member squeezing roller 13K is collected in the developer collecting section 15 separately and the flow channel of the developer of the third color collected in the developer collecting section 18C and flow channel of the developer collected in the developer collecting section 56C are merged to a single flow channel. Then, the developer of the fourth color scraped off by the cleaning blade 17K of the image carrier member 10K is collected in the developer collecting section 18K and the developer scraped off by the cleaning blade 55C of the intermediate transfer member squeezing apparatus 52K is collected in the developer collecting section 56K separately and the flow channel of the developer collected in the developer collecting section 15K and the flow channel of the developer collected in the developer collecting section 18K are merged to a single collection flow channel 70K and conveyed to the carrier buffer tank 74 by way of the pump 76K and the filter 77K, while the other developers including the developer collected in the developer collecting section 56K and the developers of the other three colors (Y, M, C) and the developers collected in the developer collecting sections of the intermediate transfer member cleaning apparatus and the secondary transfer roller cleaning apparatus are led to a single collection flow channel 70 and conveyed to the carrier buffer tank 74 by way of the pump 76 and the filter 77.

Thus, since the developer of the black color is collected independently in this embodiment, the development units of the colors other than the development unit of the black color are not driven to operate when forming a monochromatic black image and hence no developer collecting operation takes place for the other colors. Additionally, responsiveness of the system is improved because the developer of the black color is collected independently and, since the black color is the fourth color, the developer collection system of the black color is located closest to the secondary transfer unit 60 to reduce the first printing time in the monochromatic mode. The flow channels of the developers scraped off by the cleaning blades and collected are merged to the collection flow channels 70K, 70 and the collected developers are conveyed to the carrier buffer tank 74 by way of the filters 77K, 77 for storage and recycling. When the developers used for development processes in a plurality of development units are collected, the toners show color mixing and hence cannot be used in the collected state. However, since the filters 77K, 77 are arranged on the conveyance routes and toner particles are filtered, only the carriers are collected for recycling. The carrier stored in the carrier buffer tank 74 is recycled as it is distributed to the carrier cartridges 71 by way of the developer conveyance route 78 and then supplied from each of the carrier cartridges 71 with the developer supplied from the corresponding developer cartridge 72 to the corresponding developer container (reservoirs) 31.

The filter means 77K, 77 operate to filter and separate the solid toners and the paper dust from the carrier after merging the flow channels of the developers collected by the various developer collection means to the collection channel. A paper filter, an electrostatic filter or some other filter may be used for it. The carrier that is separated from the toners and ready for reuse is temporarily stored in the carrier buffer tank 74 before it is distributed to the carrier cartridges 71 of the plurality of development units. With this system arrangement, the carrier recycle ratio can be made uniform among the development units and hence the carrier can be recycled in a stable manner. Thus, the pumps 76K, 76 for conveying the developers and the filter means 77K, 77 can be used commonly for the developers of the different colors to realize a simple system at low cost with the conveyance route. The developers collected from the cleaning apparatus of the secondary transfer roller 61 and the intermediate transfer member 40 may contain foreign objects and/or paper dust and hence may well be disposed as waste without recycling from the conventional point of view. However, the filtering step of this embodiment can filter foreign objects and paper dust along with solid toners and hence the developers from the related various components can be recycled. The filtering feature of the embodiment can be stably maintained when it is provided with a system of replacing the filter means 77K, 77 to remove the toners of mixed colors, the foreign objects and the paper dust caught by the filter means 77K, 77 according to the output of a sensing means (not shown) for sensing the condition of the filter means 77K, 77.

Figure 12:
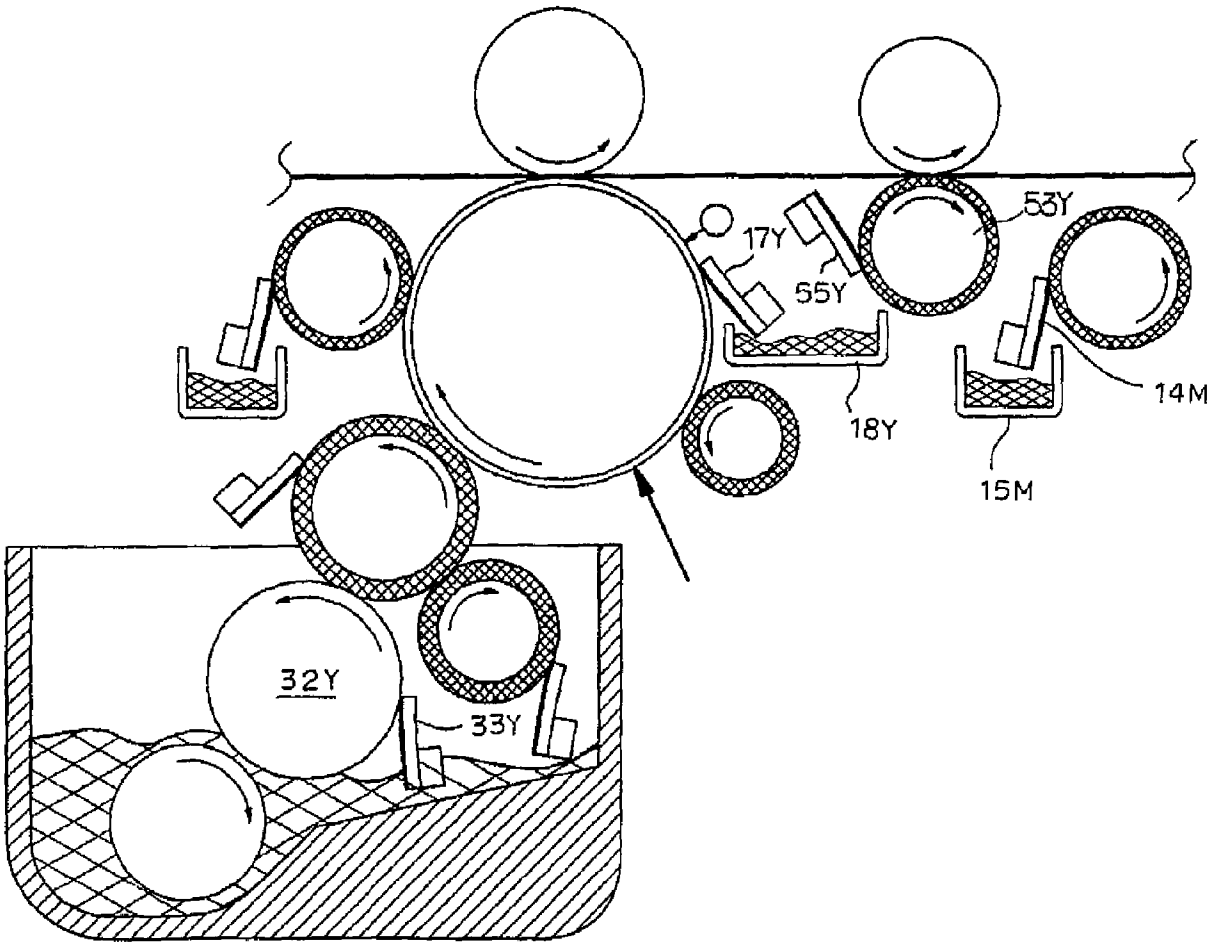
FIG. 12 is a schematic illustration of still another embodiment of developer collection system.

FIG. 12 is a schematic illustration of still another embodiment of developer collection system. FIG. 9 is a schematic illustration of still another embodiment of developer collection system. The embodiment of FIG. 12 is realized by reversing the sense of rotation of the developer supply roller 32Y relative to that of the developer supply unit 32Y of FIG. 11 showing the image forming section, the development unit and the intermediate transfer member squeezing apparatus and accordingly arranging the regulation blade 33Y not at the left side but at the right side of the developer supply unit 32Y as shown in FIG. 12, while both the developer scraped off by the cleaning blade 55Y and the developer scraped off by the cleaning blade 17Y of the image carrier member 10Y are collected by the developer collecting section 18Y. With this arrangement, the image forming sections, the development units and the intermediate transfer member squeezing apparatus of the different colors are made independent from each other. Then, the image forming section, the development unit and the intermediate transfer member squeezing apparatus of each color can be unitized. Such a unit is very compact. In the immediately preceding embodiment, the developer scraped off by the cleaning blade 55Y is collected by the developer collecting section 15M that also collects the developer scraped off by the cleaning blade 14M of the image carrier member squeezing roller 13M of the next color and hence the intervals separating adjacent primary transfer sections is reduced to by turn reduce the entire length so as to provide an advantage of making the entire apparatus compact. However, the first embodiment is accompanied by a disadvantage that the intervals separating adjacent primary transfer sections are limited. On the other hand, this arrangement of the image forming section, the development unit and the intermediate transfer member squeezing apparatus of a color is not restricted by that of the other colors in the embodiment of FIG. 12 to raise the freedom of arrangement for each color unit. The embodiment of FIG. 9 is realized by replacing the charging roller 11Y and the developer compressing roller 22Y of FIG. 2 are replaced by respective corona dischargers 11Y' and 22Y' that charge the image carrier member 10Y by corona discharge and drive the toner particles of the developer toward the development roller 20Y to realize a compressed state for the developer. The developer compressing rollers 43, the cleaning blades 44 and the developer collecting sections 45 of FIG. 10 are omitted in FIG. 9 because they may be omitted without problem.

The present invention is by no means limited to the above-described embodiments, which may be modified and altered in various different ways without departing from the scope of the present invention. For example, each of the above embodiments is described in terms of a tandem type color image forming apparatus comprising an elastic endless belt to be used as the intermediate transfer member and a plurality of image forming sections arranged in parallel to correspond to the respective development colors along the intermediate transfer member, the tandem type color image forming apparatus may be replaced by a rotary type color image forming apparatus in which a plurality of image forming sections that correspond to the respective development colors are supported by a cylindrical rotary support and moved sequentially to the transfer position of the intermediate transfer member by driving the rotary support to rotate in order to sequentially transferring toner images of the different colors so as to lay them one on the other. Such a tandem type image forming apparatus may be made to comprise an intermediate transfer drum. Then, the intermediate transfer member cleaning blade arranged on the intermediate transfer member is held away from the intermediate transfer member during the primary transfer process of transferring toner images from the image forming sections onto the intermediate transfer member and while the full color toner image or the monochromatic toner image to be transferred from the intermediate transfer member to a recording medium is passing and then the edge thereof is pressed against and held in sliding contact with the intermediate transfer member.

What is claimed is:

1. An image forming apparatus comprising:

plurality of image carrier members;

a plurality of development means for developing the electrostatic latent images formed respectively on the plurality of image carrier members by means of liquid developers of different colors containing a non-volatile solvent as carrier;

an intermediate transfer member for sequentially transferring the developer images developed by the primary transfer sections respectively corresponding to the plurality of image carrier members, superposing them one on the other and carrying and conveying the developer images;

secondary transfer means for transferring the superposed developer images from the intermediate transfer member onto a sheet on a sheet conveyance route in the secondary transfer section; and developer collection means for collecting excessive developers from at least two of the plurality of image carrier members, the plurality of development means, the intermediate transfer member and the secondary transfer means; wherein at least two of the flow channels from the developer collection means are merged to form a single flow channel, the flow channel formed by the merge is provided with a filter means, and the developer collection means are image carrier member squeezing means arranged at the upstream sides of the respective primary transfer sections of the image carrier members in the sense of the moving directions thereof.

2. An image forming apparatus comprising:

a plurality of image carrier members a plurality of development means for developing the electrostatic latent images formed respectively on the plurality of image carrier members by means of liquid developers of different colors containing a non-volatile solvent as carrier;

an intermediate transfer member for sequentially transferring the developer images developed by the primary transfer sections respectively corresponding to the plurality of image carrier members, superposing them one on the other and carrying and conveying the developer images;

secondary transfer means for transferring the superposed developer images from the intermediate transfer member onto a sheet on a sheet conveyance route in the secondary transfer section; and developer collection means for collecting excessive developers from at least two of the plurality of image carrier members, the plurality of development means, the intermediate transfer member and the secondary transfer means, wherein at least two of the flow channels from the developer collection means are merged to form a single flow channel, the flow channel formed by the merge is provided with a filter means, and the developer collection means are intermediate transfer member squeezing means arranged at the downstream sides of the respective primary transfer sections of the intermediate transfer member in the sense of the moving directions thereof.

3. An image forming apparatus comprising:

a plurality of image carrier members a plurality of development means for developing the electrostatic latent images formed respectively on the plurality of image carrier members by means of liquid developers of different colors containing a non-volatile solvent as carrier;

an intermediate transfer member for sequentially transferring the developer images developed by the primary transfer sections respectively corresponding to the plurality of image carrier members, superposing them one on the other and carrying and conveying the developer images;

secondary transfer means for transferring the superposed developer images from the intermediate transfer member onto a sheet on a sheet conveyance route in the secondary transfer section; and developer collection means for collecting excessive developers from at least two of the plurality of image carrier members, the plurality of development means, the intermediate transfer member and the secondary transfer means, wherein at least two of the flow channels from the developer collection means are merged to form a single flow channel, the flow channel formed by the merge is provided with a filter means, and the developer collection means are intermediate transfer member cleaning means arranged at the downstream side of the secondary transfer section of the intermediate transfer member in the sense of the moving directions thereof.

4. An image forming apparatus comprising:

a plurality of image carrier members a plurality of development means for developing the electrostatic latent images formed respectively on the plurality of image carrier members by means of liquid developers of different colors containing a non-volatile solvent as carrier;

an intermediate transfer member for sequentially transferring the developer images developed by the primary transfer sections respectively corresponding to the plurality of image carrier members, superposing them one on the other and carrying and conveying the developer images;

secondary transfer means for transferring the superposed developer images from the intermediate transfer member onto a sheet on a sheet conveyance route in the secondary transfer section; and developer collection means for collecting excessive developers from at least two of the plurality of image carrier members, the plurality of development means, the intermediate transfer member and the secondary transfer means, wherein at least two of the flow channels from the developer collection means are merged to form a single flow channel, the flow channel formed by the merge is provided with a filter means, and the developer collection means is cleaning means of the secondary transfer roller of the secondary transfer section.

5. An image forming apparatus comprising:

a plurality of image carrier members a plurality of development means for developing the electrostatic latent images formed respectively on the plurality of image carrier members by means of liquid developers of different colors containing a non-volatile solvent as carrier, wherein each of the plurality of development means includes:

a developer container for containing developer, a developer toner cartridge for containing developer showing a toner concentration higher than the toner concentration of the developer contained in the developer container, a carrier cartridge for containing the carrier, and a developer container for receiving the developer and the carrier supplied respectively from the developer toner cartridge and the carrier cartridge, agitating them into a uniformly dispersed state and containing them;

an intermediate transfer member for sequentially transferring the developer images developed by the primary transfer sections respectively corresponding to the plurality of image carrier members, superposing them one on the other and carrying and conveying the developer images;

secondary transfer means for transferring the superposed developer images from the intermediate transfer member onto a sheet on a sheet conveyance route in the secondary transfer section; and developer collection means for collecting excessive developers from at least two of the plurality of image carrier members, the plurality of development means, the intermediate transfer member and the secondary transfer means, wherein at least two of the flow channels from the developer collection means are merged to form a single flow channel, and the flow channel formed by the merge is provided with a filter means.

6. The image forming apparatus according to claim 5, wherein the carrier separated by the filter is stored in a carrier buffer tank and distributed to the carrier cartridges.

7. An image forming apparatus comprising:

a plurality of image carrier members;

a plurality of development means for developing the electrostatic latent images formed respectively on the plurality of image carrier members by means of liquid developers of different colors containing a non-volatile solvent as carrier;

an intermediate transfer member for sequentially transferring the developer images developed by the primary transfer sections respectively corresponding to the plurality of image carrier members, superposing them one on the other and carrying and conveying the developer images; and secondary transfer means for transferring the superposed developer images from the intermediate transfer member onto a sheet on a sheet conveyance route in the secondary transfer section;

image carrier member squeezing means arranged at the upstream sides of the respective primary transfer sections of the image carrier members in the sense of rotation thereof; and intermediate transfer member cleaning means arranged at the downstream side of the secondary transmission section of the intermediate transfer member in the sense of the moving direction thereof and at the upstream side of the primary transfer section of the first color;

the flow channels of the developer collected by the image carrier member squeezing means and the flow channel of the developer collected by the intermediate transfer member cleaning means being merged to a single flow channel.

8. The image forming apparatus according to claim 7, wherein the intermediate transfer member cleaning means includes a developer compression means for compressing the developer on the intermediate transfer member and a cleaning blade arranged downstream relative to the developer compression means in the sense of the moving direction of the intermediate transfer member and held in contact with the intermediate transfer member.

9. The image forming apparatus according to claim 8, wherein the developer compression means includes a compression roller and a cleaning blade for scraping off the developer adhering to the surface of the roller.

10. The image forming apparatus according to claim 7, wherein the developer of the merged flow channel is conveyed to a carrier buffer tank, isolated by the filter means and stored in the tank so that the stored carrier may be distributed from the carrier buffer tank to the plurality of development means.

11. The image forming apparatus according to claim 7, further comprising:

image carrier member cleaning means arranged at the downstream sides of the respective primary transfer sections of the image carrier members in the sense of rotation thereof; and intermediate transfer member squeezing means arranged at the downstream side of the primary transfer sections of the intermediate transfer member in the sense of moving direction thereof;

the flow channel of the developer collected by the intermediate transfer member squeezing means and the flow channels of the developer collected by the image carrier member squeezing means arranged at the downstream side thereof being merged to a single flow channel;

the flow channels of the developers collected by the image carrier member cleaning means being merged to the single flow channel of the merge.

12. The image forming apparatus according to claim 7 further comprising:

image carrier member cleaning means arranged at the downstream sides of the respective primary transfer sections of the image carrier members in the sense of rotation thereof; and intermediate transfer member squeezing means arranged at the downstream side of the primary transfer sections of the intermediate transfer member in the sense of moving direction thereof;

the flow channel of the developer collected by the image carrier member cleaning means and the flow channel of the developer collected by the intermediate transfer member squeezing means being merged to a single flow channel;

the single flow channel of the merge being further merged with the flow channels of the developers collected by the downstream image carrier member squeezing means.

13. The image forming apparatus according to claim 12, wherein the secondary transfer means includes a transfer roller for transferring the development image onto a sheet and a cleaning blade held in contact with the roller and the flow channel of the developer collected by the intermediate transfer member squeezing means and the flow channels of the developers collected by the image carrier member squeezing means are merged to a single flow channel, the single collection flow channel of the merge being further merged with the flow channel of the developer collected by the cleaning blade.

14. The image forming apparatus according to claim 13, wherein the collection flow channel is linked to the carrier buffer tank by way of the filter and the carrier contained in the carrier buffer tank is distributed to the plurality of development means for recycling.

15. An image forming apparatus comprising:

a plurality of image carrier members;

a plurality of development means for developing the electrostatic latent images formed respectively on the plurality of image carrier members by means of liquid developers of different colors containing a non-volatile solvent as carrier;

an intermediate transfer member for sequentially transferring the developer images developed by the primary transfer sections respectively corresponding to the plurality of image carrier members, superposing them one on the other and carrying and conveying the developer images;

secondary transfer means for transferring the superposed developer images from the intermediate transfer member onto a sheet on a sheet conveyance route in the secondary transfer section; and developer collection means including image carrier member squeezing means arranged at the upstream sides relative to the respective primary transfer sections of the image carrier members in the sense of rotation and an intermediate transfer member squeezing means arranged at the downstream side of the intermediate transfer member relative to the respective primary transfer sections;

the developers collected from the intermediate transfer member squeezing means except the intermediate transfer member squeezing means arranged at the most downstream in the sense of the moving direction of the intermediate transfer member and the developers collected from the image carrier member squeezing means arranged at the downstream sides of the respective intermediate transfer member squeezing means in the sense of the moving direction of the intermediate transfer member are collected in a single developer collection section.

16. The image forming apparatus according to claim 15, further comprising:

image carrier member cleaning means arranged at the downstream sides of the respective image carrier members relative to the respective primary transfer sections as developer collection means;

flow channels of the developers collected by the developer collecting sections of the image carrier member cleaning means arranged at the upstream sides of the intermediate transfer member relative to the respective intermediate transfer squeezing means and the flow channel of the developer collected in the single developer collecting section being merged to a single flow channel.

17. The image forming apparatus according to claim 15, further comprising:

intermediate transfer member cleaning means arranged at the downstream side of the intermediate transfer member relative to the secondary transfer section in the sense of the moving direction thereof and at the upstream side relative to the primary transfer section of the first color in the sense of the moving direction thereof, the flow channel of the developer collected in the developer collecting section of the intermediate transfer member cleaning means and the flow channel of the developer collected in the developer collecting section of the image carrier member squeezing means of the first color being merged to a single flow channel.

18. The image forming apparatus according to claim 17, wherein the secondary transfer means includes a transfer roller for transferring the developer image onto a sheet and a cleaning blade held in contact with the transfer roller and the flow channel of the developer collected from the cleaning blade is merged to the single flow channel.

19. The image forming apparatus according to claim 18, wherein the developer of the single flow channel of the merge is conveyed to a carrier buffer tank by way of a filter means to separate the carrier by means of the filter means and store the carrier in the cater buffer tank and developer conveyance means is provided to distribute the carrier stored in the carrier buffer tank from the carrier buffer tank to the plurality of development means.

20. An image forming apparatus comprising:

a plurality of image carrier members;

a plurality of development means for developing the electrostatic latent images formed respectively on the plurality of image carrier members by means of liquid developers of different colors containing a non-volatile solvent as carrier;

an intermediate transfer member for sequentially transferring the developer images developed by the primary transfer sections respectively corresponding to the plurality of image carrier members, superposing them one on the other and carrying and conveying the developer images; and secondary transfer means for transferring the superposed developer images from the intermediate transfer member onto a sheet on a sheet conveyance route in the secondary transfer section; and developer collection means including image carrier member cleaning means arranged respectively at the downstream sides of the image carrier members relative to the primary transfer sections in the sense of the moving directions thereof and intermediate transfer member squeezing means arranged at the downstream side of the intermediate transfer member relative to the primary transfer sections in the sense of the moving direction thereof, the developer from the image carrier member cleaning means and the developer from the intermediate transfer member squeezing means being collected in a single developer collecting section.

21. The image forming apparatus according to claim 20, wherein each of the plurality of development means includes a developer container for containing liquid developer, a developer cartridge for supplying developer containing toner to a high concentration in a dispersed state and a carrier cartridge for supplying carrier to the developer container and the developer collected in the single developer collecting section is distributed to the carrier cartridges.

22. The image forming apparatus according to claim 21, further comprising:

image carrier member squeezing means arranged respectively at the downstream sides of the image carrier members relative to the primary transfer sections in the sense of moving directions thereof, the flow channels of the developers collected by the image carrier member squeezing means being merged to a single flow channel to convey the collected developer to a carrier buffer tank by way of a filter and store it there in order to distribute the stored carrier to the carrier cartridges by way of the developer conveyance routes between the carrier buffer tank and the carrier cartridges.

23. The image forming apparatus according to claim 21, wherein the developer collection means include image carrier member squeezing means arranged respectively at the downstream sides of the image carrier members relative to the primary transfer sections in the sense of the moving directions thereof and the flow channel of the developer collected in the single developer collecting section and the flow channels of the developers collected by the image carrier member squeezing means arranged respectively at the downstream side of the intermediate transfer member relative to the image carrier member squeezing means in the sense of the moving direction thereof are merged to a single flow channel to convey the collected developer to a carrier buffer tank by way of a filter and store it there in order to distribute the stored carrier by way of the developer conveyance routes between the carrier buffer tank and the carrier cartridges.

24. The image forming apparatus according to claim 23, further comprising:

a carrier containing tank that can be removably fitted in order to contain the excessive carrier stored in the carrier buffer tank.

25. The image forming apparatus according to claim 24, wherein the carrier cartridges and the carrier containing tank are compatible.

26. An image forming apparatus comprising:

a plurality of image carrier members;

a plurality of development means for developing the electrostatic latent images formed respectively on the plurality of image carrier members by means of liquid developers of different colors containing a non-volatile solvent as carrier;

an intermediate transfer member for sequentially transferring the developer images developed by the primary transfer sections respectively corresponding to the plurality of image carrier members, superposing them one on the other and carrying and conveying the developer images; and secondary transfer means for transferring the superposed developer images from the intermediate transfer member onto a sheet on a sheet conveyance route in the secondary transfer section; and developer collection means arranged respectively at a plurality of positions to collect excessive developer;

a first filter being provided at the flow channel of the developer collected by the developer collection means for collecting black developer out of the developer collection means arranged at a plurality of positions, the flow channel of the developers collected by the developer collection means other than the one for collecting black developer being merged to a single flow channel, a second filter being provided at the single flow channel in order to separate the solid of the developer and the carrier by means of the filters.

27. The image forming apparatus according to claim 1, wherein the developer collection means include image carrier member squeezing means arranged respectively at the upstream sides of the image carrier members relative to the primary transfer sections in the sense of the moving directions thereof, image carrier member cleaning means arranged respectively at the downstream sides of the image carrier members relative to the primary transfer sections in the sense of the moving directions thereof and intermediate transfer member squeezing means arranged at the downstream side of the intermediate transfer member relative to the respective primary transfer sections.

28. The image forming apparatus according to claim 27, wherein the developer collection means for collecting black developer includes the image carrier member squeezing means and the image carrier member cleaning means arranged along the moving direction of the black image carrier member.

29. The image forming apparatus according to claim 26, wherein the developer collection means is the intermediate transfer member cleaning means arranged at the downstream side of the intermediate transfer member relative to the secondary transfer section in the sense of the moving direction thereof and at the upstream side of the intermediate transfer member relative to the primary transfer section of the first color in the sense of the moving direction thereof

30. The image forming apparatus according to claim 26, wherein the developer collection means is cleaning means of the transfer roller for transferring the developer image of the secondary transfer means to a sheet.

31. The image forming apparatus according to claim 26, wherein the carrier separated from the solid by way of the filters is conveyed to the carrier buffer tank and stored in the carrier buffer tank and the carrier stored in the carrier buffer tank is distributed to the plurality of development means by way of the developer conveyance routes between the carrier buffer tank and the plurality of development means.

32. The image forming apparatus according to claim 31, wherein each of the plurality of development means includes a developer cartridge and a carrier cartridge respectively containing developer showing a high toner concentration and carrier and adapted to be removably fitted to the corresponding developer container and carrier is distributed from the carrier buffer tank to the carrier cartridges.

33. The image forming apparatus according to claim 32, wherein each of the developer conveyance routes is provided with a carrier containing tank that can be removably fitted to the developer conveyance route in order to contain excessive carrier to be stored in the carrier buffer tank.

34. The image forming apparatus according to claim 33, wherein each of the carrier cartridges and the corresponding carrier containing tank are compatible.

* * * * *

UNITED STATES PATENT AND TRADEMARK OFFICE

CERTIFICATE OF CORRECTION

PATENT NO. : 7,657,210 B2
APPLICATION NO. : 11/611040
DATED : February 2, 2010
INVENTOR(S) : Aruga et al.

It is certified that error appears in the above-identified patent and that said Letters Patent is hereby corrected as shown below:

Title page, Col. 1, line 30, change "Dec. 20, 2005(JP)..... 2055-367493" to --Dec. 21, 2005 (JP)..... 2055-367493--.

Signed and Sealed this

Sixth Day of April, 2010

David J. Kappos

David J. Kappos
*Director of the United States Patent and Trademark Office*